US009177514B2

(12) United States Patent
Ishihara

(10) Patent No.: US 9,177,514 B2
(45) Date of Patent: Nov. 3, 2015

(54) IMAGE DISPLAY APPARATUS AND IMAGE DISPLAY METHOD

(75) Inventor: Tomoyuki Ishihara, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 161 days.

(21) Appl. No.: 13/980,360

(22) PCT Filed: Jan. 16, 2012

(86) PCT No.: PCT/JP2012/050684

§ 371 (c)(1),
(2), (4) Date: Jul. 18, 2013

(87) PCT Pub. No.: WO2012/099039

PCT Pub. Date: Jul. 26, 2012

(65) Prior Publication Data

US 2013/0293598 A1 Nov. 7, 2013

(30) Foreign Application Priority Data

Jan. 20, 2011 (JP) ..... 2011-009399

(51) Int. Cl.
*G09G 3/36* (2006.01)

(52) U.S. Cl.
CPC ..... *G09G 3/3607* (2013.01); *G09G 3/3648* (2013.01); *G09G 2310/0235* (2013.01); *G09G 2320/0242* (2013.01); *G09G 2320/064* (2013.01)

(58) Field of Classification Search
CPC combination set(s) only.
See application file for complete search history.

(56) References Cited

U.S. PATENT DOCUMENTS 6,115,016 A 9/2000 Yoshihara et al.
2002/0057253 A1 5/2002 Lim et al.
2002/0122019 A1 9/2002 Baba et al.
2005/0088625 A1 4/2005 Imade
2005/0237433 A1 * 10/2005 Van Dijk et al. ..... 348/702

(Continued)

FOREIGN PATENT DOCUMENTS

JP 09-90916 A 4/1997
JP 3215913 B2 10/2001

(Continued)

OTHER PUBLICATIONS

International Search Report PCT/ISA/210 for PCT/JP2012/050684 dated Feb. 14, 2012.

(Continued)

*Primary Examiner* — Kumar Patel
*Assistant Examiner* — Amy C Onyekaba
(74) *Attorney, Agent, or Firm* — Harness, Dickey & Pierce, P.L.C.

(57) ABSTRACT

An image display apparatus operates in field sequence mode which effectively reduces the generation of color break. A color break strength calculating unit determines a color break strength that indicates the noticeability of the generation of the color break. A light-source signal generating unit controls each light source so that as the color break strength of a color mixed component having the highest color break strength is higher, the color mixed component is contained more in light output from a light-source unit during the extension subframe period. If there is present a first pixel region as an area including one or more pixel formation regions where an image containing the component of interest is displayed, the color break strength of the component of interest increases more as a magnitude of the component of interest is larger in the first pixel region.

34 Claims, 17 Drawing Sheets

(56) References Cited

U.S. PATENT DOCUMENTS

| | | | | |
|---|---|---|---|---|
| 2009/0135205 | A1* | 5/2009 | Wu et al. | 345/690 |
| 2010/0259552 | A1* | 10/2010 | Hsu | 345/592 |
| 2010/0295865 | A1* | 11/2010 | Wu et al. | 345/589 |

FOREIGN PATENT DOCUMENTS

| | | | |
|---|---|---|---|
| JP | 2002-191055 | A | 7/2002 |
| JP | 2003-76341 | A | 3/2003 |
| JP | 2003-241165 | A | 8/2003 |
| JP | 2003-248462 | A | 9/2003 |
| JP | 2005-134482 | A | 5/2005 |
| JP | 3952362 | B2 | 8/2007 |
| JP | 2007-310286 | A | 11/2007 |

OTHER PUBLICATIONS

Written Opinion PCT/ISA/237 for PCT/JP2012/050684 dated Feb. 14, 2012.

* cited by examiner

FIG. 9

| | | | | | | |
|---|---|---|---|---|---|---|
| 0 | 0 | 0 | 0 | 0 | 0 | 0 |
| 0 | 0 | 20 | 60 | 70 | 40 | 0 |
| 0 | 0 | 60 | 70 | 80 | 70 | 0 |
| 0 | 10 | 40 | 90 | 70 | 70 | 0 |
| 0 | 10 | 40 | 30 | 50 | 30 | 0 |
| 0 | 10 | 20 | 20 | 40 | 10 | 0 |
| 0 | 0 | 0 | 0 | 0 | 0 | 0 |

61
62
63

FIG. 10

| | | | | | | |
|---|---|---|---|---|---|---|
| 0 | 2 | 9 | 17 | 19 | 14 | 4 |
| 0 | 9 | 23 | 40 | 43 | 29 | 12 |
| 1 | 14 | 39 | 62 | 69 | 44 | 20 |
| 2 | 18 | 39 | 59 | 62 | 41 | 19 |
| 3 | 14 | 30 | 44 | 46 | 30 | 12 |
| 2 | 9 | 14 | 22 | 20 | 14 | 4 |
| 1 | 3 | 6 | 9 | 8 | 6 | 1 |

61
62
63

FIG. 13

| | | | | | | |
|---|---|---|---|---|---|---|
| 150 | 160 | 170 | 175 | 175 | 155 | 150 |
| 160 | 165 | 180 | 185 | 185 | 160 | 155 |
| 170 | 170 | 180 | 190 | 180 | 160 | 160 |
| 170 | 170 | 190 | 200 | 190 | 175 | 170 |
| 160 | 170 | 180 | 195 | 190 | 175 | 170 |
| 150 | 170 | 180 | 190 | 185 | 170 | 165 |
| 150 | 165 | 160 | 170 | 160 | 160 | 160 |

71

FIG. 14

| | | | | | | |
|---|---|---|---|---|---|---|
| 150 | 160 | 170 | 175 | 175 | 155 | 150 |
| 160 | 165 | 180 | 185 | 185 | 160 | 155 |
| 170 | 170 | 180 | 190 | 180 | 160 | 160 |
| 170 | 170 | 190 | 200 | 190 | 175 | 170 |
| 160 | 170 | 180 | 195 | 190 | 175 | 170 |
| 150 | 170 | 180 | 190 | 185 | 170 | 165 |
| 150 | 165 | 160 | 170 | 160 | 160 | 160 |

72

IMAGE DISPLAY APPARATUS AND IMAGE DISPLAY METHOD

TECHNICAL FIELD

The present invention relates to an image display apparatus and an image display method, and more in detail, a technique of controlling the generation of color break in an image display apparatus that operates in a field sequential mode.

BACKGROUND ART

Many of the liquid crystal display apparatuses that display a color image include a color filter that allows light rays of red (R), green (G), and blue (B) to pass through respectively three sub pixels into which one pixel is divided. Since about two-thirds of backlight rays irradiating a liquid crystal panel are absorbed by the color filter, a color-filter liquid crystal display apparatus has a problem of low light use efficiency. For this reason, a field-sequential liquid display apparatus that displays a color image without using the color filter gains attention.

In accordance with the field sequential technique, a display period (1 frame period) of one screen is divided into three subframe periods. The subframe period is also referred to as a subfield period. In the discussion that follows, the term subframe period is used consistently. During a first subframe period, a red screen is displayed in response to a red component of an input signal. During a second subframe period, a green screen is displayed in response to a green component of the input signal. During a third subframe period, a blue screen is displayed in response to a blue component of the input signal. As described above, colors are displayed one by one so that a color image is displayed on a liquid crystal panel. The field-sequential liquid crystal display apparatus is free from the color filter, and provides a light use efficiency about 3 times as high as that of the color-filter liquid crystal display apparatus.

However, the field sequential color technique suffers from a problem of a generation of color break. FIG. 27 illustrates the generation principle of the color breaking. In a section A of FIG. 27, the ordinate represents time, and the abscissa represents location on a screen. When an object moves within a display screen, a line of sight of a viewer typically keeps track of the object and moves in a movement direction of the object. For example, when a white object moves from left to right within the screen display as illustrated in FIG. 27, the line of sight of the viewer moves in a slant arrow-headed line direction. If the three subframe images of R, G, and B are extracted from a video at the same instant, the objects in the subframe images are at the same location. For this reason, a color break takes place in the video focused on the retina as illustrated in a section B of FIG. 27.

Japanese Patent No. 3766274 describes as below how the color break is reduced in a color display apparatus such as a liquid crystal display apparatus. In the color display apparatus, one frame period includes at least 4 or more subframes. The first through third subframes respectively display red, green, and blue. The fourth subframe displays a color presentation of non-3-primary colors, i.e., a presentation of at least two colors (a color mixed display). A color displayed by the fourth subframe is determined by performing a specific statistic process on an original image signal including an RGB signal of one frame.

The following related art in the field of the present invention is also known. According to Japanese Unexamined Patent Application Publication No. 9-90916, one frame period includes three subframes of the 3-primary colors of red, green, and blue, and a subframe of white or of an intermediate color between the three-primary colors. According to Japanese Patent No. 3215913, one frame period is divided into four subframes, and a fourth subframe presents a white display. According to Japanese Patent No. 3952362, one frame period is divided into four subframes, and the color of a light source that lights on in a fourth subframe is determined based on the mean value of luminance of the colors. According to Japanese Unexamined Patent Application Publication No. 2003-241165, RGB driving and RGBW driving is switchable so that the RGB driving is performed in a bright environment, and the RGBW driving is performed in a dark environment in order to prevent color breaking.

CITATION LIST

Patent Literature

PTL 1: Japanese Patent No. 3766274
PTL 2: Japanese Unexamined Patent Application Publication No. 9-90916
PTL 3: Japanese Patent No. 3215913
PTL 4: Japanese Patent No. 3952362
PTL 5: Japanese Unexamined Patent Application Publication No. 2003-241165

SUMMARY OF INVENTION

Technical Problem

According to the invention described in Japanese Patent 3766274, the color break control effect is not sufficient if a displayed image causes the color break to be strongly visibly recognized in a localized fashion. Since the color displayed in the fourth subframe is limited to non-three-primary colors, a plurality of light sources light on when an image, from which color breaking is less noticeable, is displayed. The disclosed invention is not beneficial from the standpoint of power saving.

It is an object of the present invention to provide a field-sequential image display apparatus that effectively controls the generation of color breaking.

Solution to Problem

According to a first aspect of the present invention, there is provided an image display apparatus including a display unit that includes a plurality of pixel formation regions arranged in a matrix, and a light-source unit that includes light sources of a plurality of colors to irradiate the display unit with light and controls the light sources for a light-on state/light-off state on a per color basis. The image display apparatus displays a color video image by dividing one frame period into a plurality of subframe periods, and by switching on a light source for the light-on state to select the color thereof on a per subframe period basis. The image display apparatus includes a color break strength calculating unit that determines a color break strength, serving as an index indicating the noticeability of a color break, of a color mixed component that is a mixture of two or more color components, in accordance with a target image that is an image to be displayed on the display unit during each frame period, and a light-source control unit that controls states of the light sources of the plurality of colors during each subframe period in accordance with the color break strength of each color mixed component. One frame period includes a mono-color light-on subframe period during which the light sources of the plurality of colors light on with one color at a time, and an extension subframe period during which the light sources of the plurality of colors take any state. If, as for any color mixed component of interest with the target image displayed on the display unit, a first pixel region is present as an area including one or more pixel formation regions where an image containing the component of interest is to be displayed, the color break strength calculating unit increases the color break strength of the component of interest more as a magnitude of the component of interest is larger in the first pixel region. The light-source control unit controls the states of the light sources of the plurality of colors during the extension subframe period so that as the color break strength of a maximum color mixed component being a color mixed component having the highest color break strength is higher, a magnitude of the maximum color mixed component contained in light output from the light-source unit is larger during the extension subframe period.

According to a second aspect of the present invention, in view of the first aspect of the present invention, if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size.

According to a third aspect of the present invention, in view of the first aspect of the present invention, if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a distance between the first pixel region and the second pixel region is shorter.

According to a fourth aspect of the present invention, in view of the first aspect of the present invention, if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the maximum mono-color component is smaller in magnitude in the second pixel region.

According to a fifth aspect of the present invention, in view of the first aspect of the present invention, if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a difference in magnitude between the maximum mono-color component in the second pixel region and a minimum mono-color component in the second pixel region is smaller.

According to a sixth aspect of the present invention, in view of the first aspect of the present invention, if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size, increases the color break strength of the component of interest more as a distance between the first pixel region and the second pixel region is shorter, increases the color break strength of the component of interest more as the maximum mono-color component is smaller in magnitude in the second pixel region, and increases the color break strength of the component of interest more as a difference in magnitude between the maximum mono-color component in the second pixel region and a minimum mono-color component in the second pixel region is smaller.

According to a seventh aspect of the present invention, in view of the sixth aspect of the present invention, if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=F1(C)\times G1(M)\times G2(S)\times F2(A)\times G3(D)$$

where C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

According to an eighth aspect of the present invention, in view of the sixth aspect of the present invention, if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=K\times F1(C)\times G1(M)\times G2(S)\times F2(A)\times G3(D)$$

where K represents a coefficient or a function, predetermined for the component of interest, C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

According to a ninth aspect of the present invention, in view of the first aspect of the present invention, the color break strength calculating unit determines the color break strength of each color mixed component by performing a predetermined weighting process on the color mixed component.

According to a tenth aspect of the present invention, in view of the first aspect of the present invention, one frame period includes N extension subframe periods (N is an integer equal to or above 2). With first through N-th color mixed components rated in order in terms of color break strength and respectively referred to as first through N-th components of interest, the light-source control unit controls the states of the light sources of the plurality of colors during the N extension subframe periods so that each of the N components of interest becomes the maximum color mixed component contained in the light output from the light-source unit during any one of the N extension subframe periods.

According to an eleventh aspect of the present invention, in view of the first aspect of the present invention, if the color break strengths of all the color mixed components contained in the light output from the light-source unit are smaller in magnitude than a predetermined color break strength, the light-source control unit controls the states of the light sources of the plurality of colors during the extension subframe period so that all the light sources of the plurality of colors are in the light-off state during the extension subframe period.

According to a twelfth aspect of the present invention, in view of the first aspect of the present invention, if the color break strengths of all the color mixed components contained in the light output from the light-source unit are smaller in magnitude than a predetermined color break strength, the light-source control unit controls the states of the light sources of the plurality of colors during each extension subframe period so that a light source of any one color from among the light sources of the plurality of colors shifts to the light-on state during the extension subframe period and so that the light source of the color in the light-on state during the extension subframe period also shifts to the light-on state during the mono-color light-on subframe period but at a light emission level lower than a standard light emission level in view of a light emission level during the extension subframe period.

According to a thirteenth aspect of the present invention, in view of the first aspect of the present invention, if a color mixed component having the highest color break strength from among all the color mixed components contained in the light output from the light-source unit changes from a first color mixed component to a second color mixed component in response to a change in the target image, the light-source control unit controls the states of the light sources of the plurality of colors during the extension subframe period so that, of the color mixed components contained in the light output from the light-source unit, the second color mixed component gradually increases in magnitude after the first color mixed component gradually decreases in magnitude during the extension subframe periods across a plurality of consecutive frame periods.

According to a fourteenth aspect of the present invention, there is provided an image display method of an image display apparatus including a display unit that includes a plurality of pixel formation regions arranged in a matrix, and a light-source unit that includes light sources of a plurality of colors to irradiate the display unit with light, and controls the light sources for a light-on state/light-off state on a per color basis. The image display apparatus displays a color video image by dividing one frame period into a plurality of subframe periods, and by switching on a light source for the light-on state to select the color thereof on a per subframe period basis. The image display method includes a color break strength calculating step of determining a color break strength, serving as an index indicating the noticeability of a color break, of a color mixed component that is a mixture of two or more color components, in accordance with a target image that is an image to be displayed on the display unit during each frame period, and a light-source control step of controlling states of the light sources of the plurality of colors during each subframe period in accordance with the color break strength of each color mixed component. One frame period includes a mono-color light-on subframe period during which the light sources of the plurality of colors light on with one color at a time, and an extension subframe period during which the light sources of the plurality of colors take any state. If, with any color mixed component set as a component of interest and with the target image displayed on the display unit, a first pixel region is present as an area including one or more pixel formation regions where an image containing the component of interest is to be displayed, the color break strength calculating step includes increasing the color break strength of the component of interest more as a magnitude of the component of interest is larger in the first pixel region. The light-source control step includes controlling the states of the light sources of the plurality of colors during the extension subframe period so that as the color break strength of a maximum color mixed component being a color mixed component having the highest color break strength is higher, a magnitude of the maximum color mixed component contained in light output from the light-source unit is larger during the extension subframe period.

Advantageous Effects of Invention

According to the first aspect of the present invention, in the image display apparatus operating in the field sequential mode, one frame period includes the mono-color light-on subframe and the extension subframe period. During the extension subframe period, the state of the light source is controlled so that the color mixed component having the highest color break strength serving as an index of the noticeability of the generation of the color break (the maximum color mixed component) is contained more in the light output from the light source. Also, the higher the color break strength of the maximum color mixed component is, the more the maximum color mixed component is contained in the light output from the light source during the extension subframe period. The color break strength of a given color mixed component serving as a component of interest, if the first pixel region as the area where an image containing the component of interest is displayed is present, is increased more as the component of interest is contained more in the first pixel region of the target image. In this way, the image display apparatus operating in the field sequential mode reduces the generation of the color break when an image that suffers from a strong color break in a localized fashion is displayed.

According to the second aspect of the present invention, the color break strength is determined in view of two factors related to the noticeability with which the color break strength is visibly recognized. The generation of the color break is effectively reduced when the image in which a color break appears strongly in a localized fashion is displayed.

According to the third aspect of the present invention, as is the case with the second aspect of the present invention, the generation of the color break is effectively reduced when the image in which a color break appears strongly in a localized fashion is displayed.

According to the fourth aspect of the present invention, as is the case with the second aspect of the present invention, the generation of the color break is effectively reduced when the image in which a color break appears strongly in a localized fashion is displayed.

According to the fifth aspect of the present invention, as is the case with the second aspect of the present invention, the generation of the color break is effectively reduced when the image in which a color break appears strongly in a localized fashion is displayed.

According to the sixth aspect of the present invention, the color break strength is determined in view of five factors related to the noticeability with which the color break strength is visibly recognized. The generation of the color break is thus more effectively reduced when the image in which a color break appears strongly in a localized fashion is displayed.

According to the seventh aspect of the present invention, as is the case with the sixth aspect of the present invention, the generation of the color break is more effectively reduced when the image in which a color break appears strongly in a localized fashion is displayed.

According to the eight aspect of the present invention, as is the case with the sixth aspect of the present invention, the generation of the color break is more effectively reduced when the image in which a color break appears strongly in a localized fashion is displayed. Also, the color break strength is determined by performing the predetermined weighting process on each color mixed component. The advantage of reducing the color break is even more increased by performing the weighting process in view of the noticeability with which a person visibly recognizes the color break strength.

According to the ninth aspect of the present invention, the color break strength is determined by performing the predetermined weighting process on each color mixed component. The advantage of reducing the color break is even more increased by performing the weighting process in view of the noticeability with which a person visibly recognizes the color break strength.

According to the tenth aspect of the present invention, the generation of the color break is effectively reduced when an image in which a plurality of color mixed components suffer from color break is displayed.

According to the eleventh aspect of the present invention, all the light sources shift to the light-off state when an image from which the color break is less visibly recognized is displayed. This lead to a reduction in power consumption. Since this arrangement introduces a black display period in one frame period, the generation of a phenomenon called "motion blur" in moving image displaying is reduced. As described above, power consumption is reduced, and display quality is increased.

According to the twelfth aspect of the present invention, the needless lighting of the light source during the extension subframe period is controlled when an image from which the color break is less visibly recognized is displayed. A reduction in the power consumption thus results. If a current control driving mechanism is employed that current controls a light source with current-luminance characteristics in which a conversion efficiency from current to luminance decreases with an increasing current, power consumption is effectively reduced by driving a light source of any one of the colors with a relatively low current by several times. Since not all the light sources are shifted to the light-off state during the extension subframe period, the generation of flickering is reduced.

According to the thirteenth aspect of the present invention, when there is a change in the color mixed component with the color break strength that is strongly visibly recognized in response to a change in the target image, the color mixed component contained in the light output from the light-source unit during the extension subframe period gradually changes across a plurality of frame periods. For this reason, the generation of flickering on a screen with the target image changed is reduced.

According to the fourteenth aspect of the present invention, the image display method provides the same advantages as those of the first aspect of the present invention.

BRIEF DESCRIPTION OF DRAWINGS

FIG. 9 illustrates a blurring process in the first embodiment of the present invention.

FIG. 10 illustrates the blurring process in the first embodiment of the present invention.

FIG. 13 illustrates how to determine the first pixel region in the first embodiment of the present invention.

FIG. 14 illustrates how to determine the first pixel region in the first embodiment of the present invention.

DESCRIPTION OF EMBODIMENTS

Embodiments of the present invention are described below with reference to the drawings. In the discussion that follows, each single color component is referred to as a "mono-color component", and a combination of two or more color components is referred to as a "color mixed component".

First Embodiment 1.1 General Configuration and Operation Description

Figure 1:
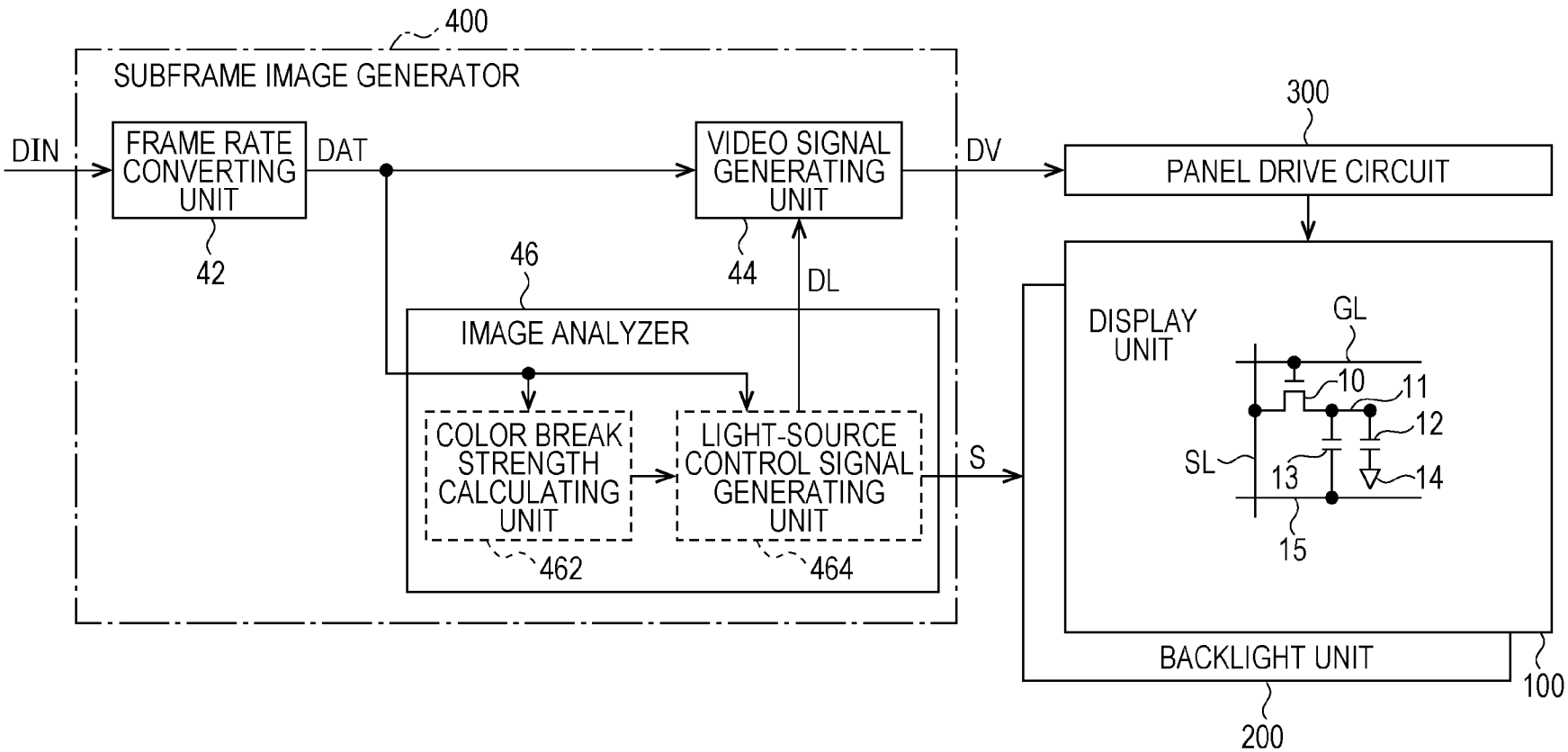
FIG. 1 is a block diagram illustrating a general configuration of a liquid crystal display apparatus of a first embodiment of the present invention.

FIG. 1 is a block diagram illustrating a general configuration of a liquid crystal display apparatus of a first embodiment of the present invention. The liquid crystal display apparatus includes a display unit 100, a backlight unit 200, a panel drive circuit 300, and a subframe image generator 400. The subframe image generator 400 includes a subframe rate converting unit 42, a video signal generating unit 44, and an image analyzer 46. The image analyzer 46 includes a color break strength calculating unit 462, and a light-source control signal generating unit (light-source controller) 464. The backlight unit 200 includes three-color LEDs of red (R), green (G), and blue (B) as backlights (light sources), and an LED control circuit that controls the states (light-on state/light-off state) of the LEDs. A plurality of LEDs are typically arranged for each color.

The display unit 100 includes a plurality of source bus lines (video signal lines) SL and a plurality of gate bus lines (scan signal lines) GL. A pixel formation region forming a pixel is disposed at each intersection of the source bus lines and the gate bus lines. Specifically, the display unit 100 includes a plurality of pixel formation regions. The plurality of pixel formation regions are disposed in a matrix, thereby forming a pixel array. Each pixel formation region includes a TFT 10 as a switching element having a gate terminal connected to the gate bus line GL passing through a corresponding intersection and having a source terminal connected to the source bus line SL passing through the corresponding intersection, a pixel electrode 11 connected to a drain terminal of the TFT 10, a common electrode 14 and an assisting storage capacitor electrode 15, commonly disposed to the plurality of pixel formation regions, a liquid crystal capacitor 12 formed of the pixel electrode 12 and the common electrode 14, and an assisting capacitor 13 formed of the pixel electrode 11 and the assisting capacitor electrode 15. The liquid crystal capacitor 12 and the assisting capacitor 13 form a pixel capacitor. Note that FIG. 1 illustrates elements of a single pixel formation region in the display unit 100.

Figure 2:
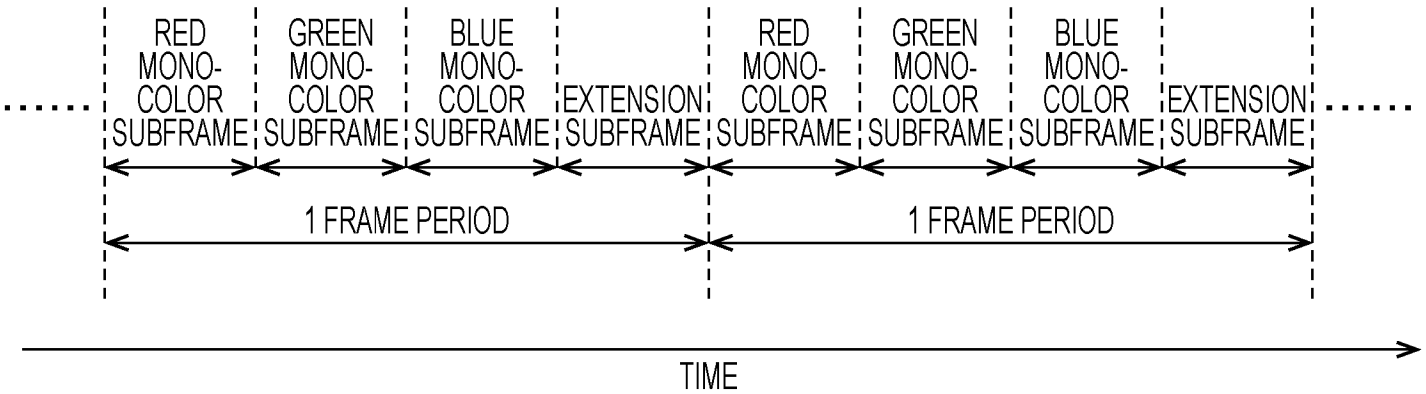
FIG. 2 illustrates a structure of a frame period in the first embodiment of the present invention.

A process to display one screen of image is performed using one frame. In the present embodiment, however, one frame period includes four subframes, i.e., a red mono-color subframe period, a green mono-color subframe period, a blue mono-color subframe period, and an extension subframe period as illustrated in FIG. 2. During the red mono-color subframe period, only a red LED is in the light-on state, thereby displaying a red image. During the green mono-color subframe period, only a green LED is in the light-on state, thereby displaying a green image. During the blue mono-color subframe period, only a blue LED is in the light-on state, thereby displaying a blue image. During the extension subframe period, each LED takes any state. Typically during the extension subframe period, LEDs of any two colors or LEDs of all the colors are in the light-on state. If the LEDs of two colors are in the light-on state, a color mixed image of two colors is displayed. If the LEDs of all colors are in the light-on state, a white image is displayed.

An operation of the elements of FIG. 1 is described. The frame rate converting unit 42 converts a frame rate of an input image signal DIN input from the outside. In the present embodiment, the frame rate converting unit 42 receives the input image signal DIN of 60 Hz and outputs data of 240 Hz as target image data. The frame rate (display frame rate) of an image to be displayed on the display unit 100 is therefore 240 Hz. Data of frames, the number of which is increased through the frame rate conversion, may be obtained by repeating the same frame image, or by using a time interpolated image that is estimated through a motion detection process that places an emphasis on smoothness on motion, or by using an image that is determined through weighted averaging a prior frame image and a subsequent subframe. The conversion method of the frame rate is not limited to any particular method. The frame rate of the input image signal DIN is not limited to 60 Hz, but may be 15 Hz, 24 Hz, or 50 Hz. In a display apparatus that displays a still image such as a digital photo frame (a display apparatus for displaying a digital photograph), an image signal read from a memory that pre-stores an image may serve as an input image signal. In such a display apparatus, the use of a mechanism that allows a display frame rate to be set in response to a read rate from the memory makes unnecessary the frame rate converting unit 42.

The color break strength calculating unit 462 in the image analyzer 46 determines the color break strength, as an index of the noticeability of the generation of color break, of each color mixed component that may be contained in light output from the backlight unit in accordance with target image data DAT output from the frame rate converting unit 42. Since three-color LEDs of red, green and blue are employed as the light sources in the present embodiment, the light output from the backlight unit includes four color mixed components of a white component, a yellow component, a magenta component, and a cyan component. The color break strength calculating unit 462 thus determines the color break strengths of these four color mixed components. The white component is a color mixed component of the red component, the green component, and the blue component. The yellow component is a color mixed component of the red component and the green component. The magenta component is a color mixed component of the red component and the blue component. The cyan component is a color mixed component of the green component and the blue component. The determination method of the color break strength is described in detail as below.

The light-source control signal generating unit 464 in the image analyzer 46 determines an amount of emission of the three-color LEDs during each subframe period in accordance with the target image data DAT output from the frame rate converting unit 42 and the color break strength of each color mixed component determined by the color break strength calculating unit 462. The light-source control signal generating unit 464 then outputs light emission data DL indicative of the amount of emission and a light-source control signal S that controls the backlight unit 200 so that each LED shifts to a state (light-on state/light-off state) in response to the amount of light emission. The light-source control signal S may be a signal instructing each LED to shift to the light-on state/light-off state (on/off in time direction), a signal instructing each LED to light at specified luminance, or a combination thereof.

The video signal generating unit 44 generates a digital video signal DV as a signal that controls a time aperture rate of liquid crystal in each pixel formation region, in accordance with the target image data DAT output from the frame rate converting unit 42 and the light emission data DL output from the light-source control signal generating unit 464. The video signal generating unit 44 then outputs the digital video signal DV. It is noted that the term time aperture rate refers to an integral value that results from integrating transmittance of the liquid crystal in time.

The panel drive circuit 300 selectively drives the gate bus lines with one line at a time, and supplies a driving video signal to each source bus line SL in response to the digital video signal DV output from the video signal generating unit 44. Charge is thus accumulated on the pixel capacitor of each pixel formation region in response to the driving video signal. The backlight unit 200 controls the state of each LED in response to the light-source control signal S output from the light-source control signal generating unit 464.

The elements operate in this way, thereby switching a display state on a per subframe basis. The display unit 100 thus displays an image responsive to the input image signal DIN.

1.2 Display Color in Each Subframe

Figure 3:
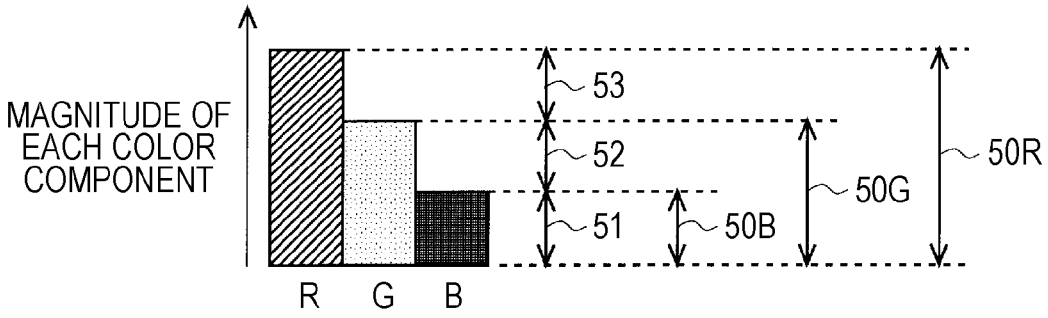
FIG. 3 illustrates a color mixed component in the first embodiment of the present invention.

Display color (the color of lighting LED) during each subframe period is described. The color mixed component is described with reference to FIG. 3. As illustrated in FIG. 3, the magnitudes of the mono-color components of red (R), green (G), and blue (B) are represented by length in a vertical direction. For example, it is assumed that one pixel in the target image includes a red component having a magnitude represented by an arrow mark labeled reference numeral 50R, a green component having a magnitude represented by an arrow mark labeled reference numeral 50G, and a blue component having a magnitude represented by an arrow mark labeled reference numeral 50B. This may be interpreted to mean that "the pixel includes a white component having a magnitude represented by an arrow mark labeled reference numeral 51, a yellow component having a magnitude represented by an arrow mark labeled reference numeral 52, and a red component having a magnitude represented by an arrow mark labeled reference numeral 53". The white component is a color mixed component of the three colors of the red component, the green component, and the blue component, and the yellow component is a color mixed component of the two colors of the red component and the green component.

Figure 4:
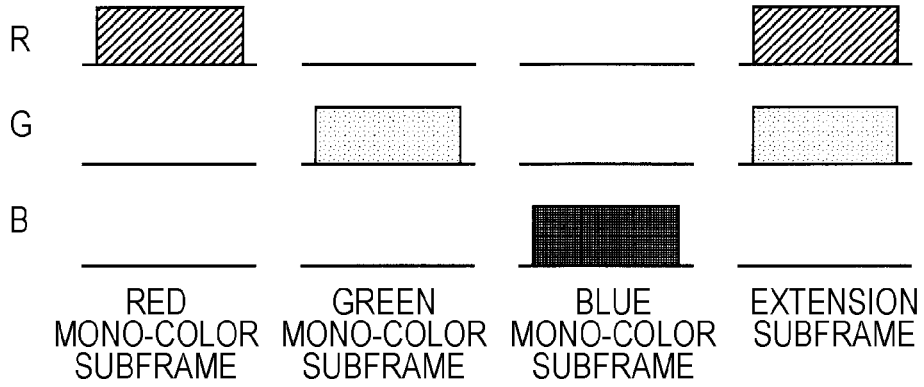
FIG. 4 illustrates a display color in each subframe in the first embodiment of the present invention.

FIG. 4 diagrammatically illustrates a display color during each subframe period. As illustrated in FIG. 4, a red image is displayed during a red mono-color subframe period, a green image is displayed during a green mono-color subframe period, and a blue image is displayed during a blue mono-color subframe period. In the present embodiment, during the extension subframe period, a color mixed image of two colors or a color mixed image of the three colors (white image) is displayed in accordance with the color break strength of each color mixed component determined by the color break strength calculating unit 462. FIG. 4 illustrates an example in which a color mixed image of red and green (yellow image) is displayed.

Figure 5:
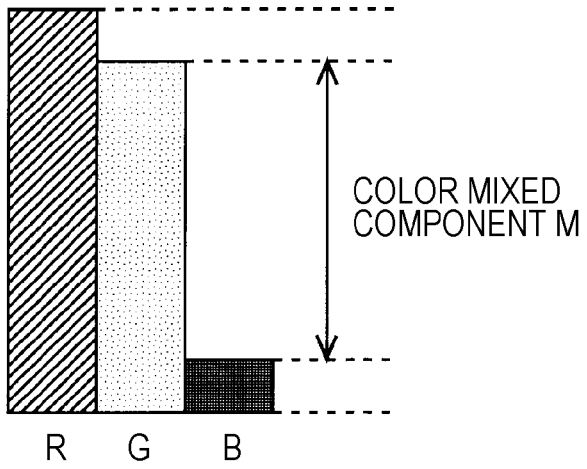
FIG. 5 illustrates how to determine a display color in an extension subframe in the first embodiment of the present invention.
Figure 6:
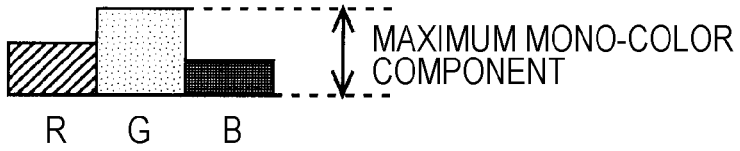
FIG. 6 illustrates how to determine the display color in the extension subframe in the first embodiment of the present invention.
Figure 7:
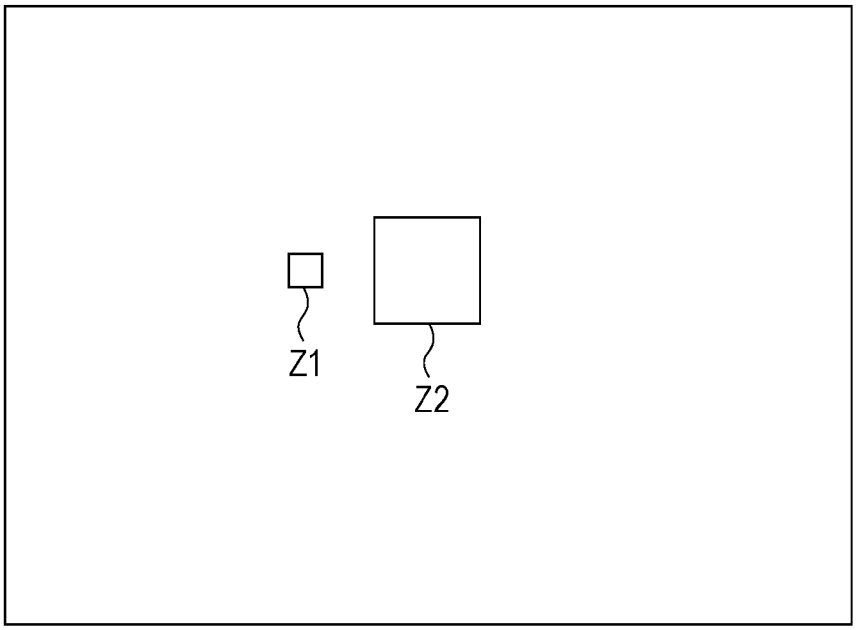
FIG. 7 illustrates how to determine the display color in the extension subframe in the first embodiment of the present invention.

Described next is a method of determining a display color during the extension subframe period. If there is present, in the target image, a region (hereinafter referred to as a "first pixel region") Z1 (see FIG. 5 and FIG. 7) including at least one pixel having a maximum color mixed component as a given color mixed component ("color mixed component M", for example), and a region (hereinafter referred to as "a second pixel region") Z2 (see FIG. 6 and FIG. 7) including at least one pixel having a maximum mono-color component (component value) smaller than the color mixed component M in the first pixel region Z1, a display color during the extension subframe period is determined to satisfy the following conditions 1 through 5.

1: As the color mixed component (component value) is larger in magnitude in the first pixel region Z1, a larger number of color mixed components M are contained in the display color during the extension subframe period.

2: As the color mixed component (component value) is smaller in magnitude in the second pixel region Z2, a larger number of color mixed components M are contained in the display color during the extension subframe period.

3: As a difference between a maximum color mixed component (component value) in the second pixel region Z2 and a minimum color mixed component (component value) in the second pixel region Z2 (i.e., saturation in the second pixel region Z2) is smaller, a larger number of color mixed components M are contained in the display color during the extension subframe period.

4: As the second pixel region Z2 is larger in area size, a larger number of color mixed components M are contained in the display color during the extension subframe period.

5: As a distance between the first pixel region Z1 and the second pixel region Z2 is smaller, a larger number of color mixed components M are contained in the display color during the extension subframe period.

The magnitude of each of the mono-color component and the color mixed component (component value) is preferably calculated as an integral value resulting from a curve of change of the light-on period of the backlight unit and the transmittance of the liquid crystal. Alternatively, to reduce load on a computing circuit and software, a signal gradation may be used or a luminance value which is obtained by performing a gamma conversion on the signal gradation may be used. The distance between the first pixel region Z1 and the second pixel region Z2 may be a distance between the center of gravity of the first pixel region Z1 and the center of gravity of the second pixel region Z2, or a distance between the point of the first pixel region Z1 and the point of the second pixel region Z2 closest to each other.

Described in detail below are a determination method of the first pixel region Z1, a determination method of the second pixel region Z2, a determination method of the color break strength, and the state of each LED during the extension subframe period. The determination methods are described below for exemplary purposes only, and the present invention is not limited to these methods.

1.2.1 Determination Method of First Pixel Region

The determination method of the first pixel region Z1 is described below. The first pixel region Z1 is determined on a per color mixed component basis. Specifically, in the present embodiment, the first pixel region Z1 is determined for each of the white component, the yellow component, the magenta component, and the cyan component.

Figure 8:
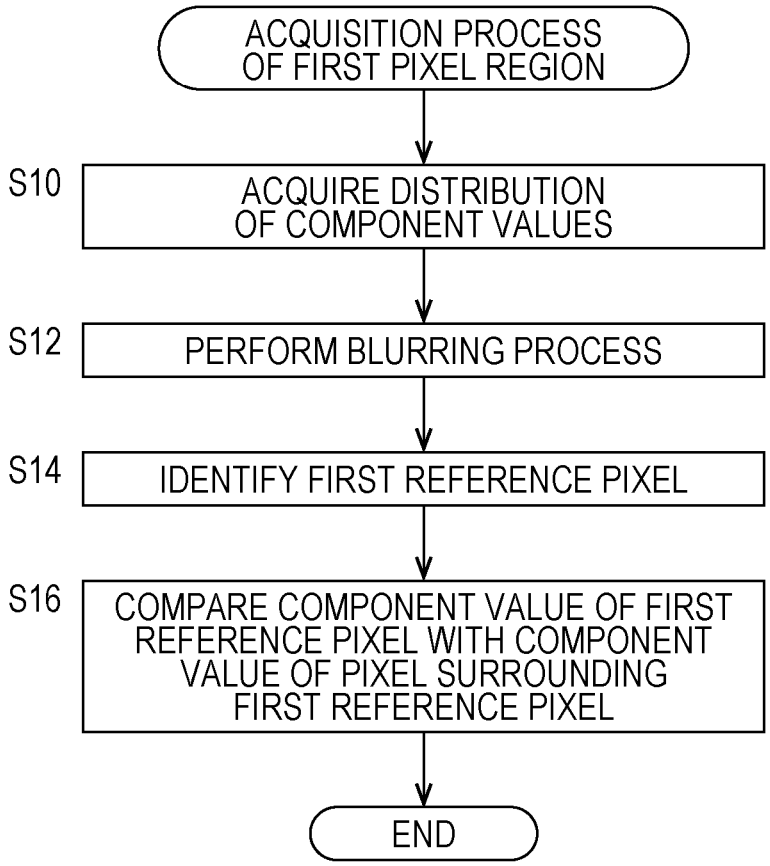
FIG. 8 is a flowchart illustrating a procedure of an acquisition process of a first pixel region in the first embodiment of the present invention.

FIG. 8 is a flowchart illustrating a procedure of a process to determine the first pixel region Z1 with any color mixed component handled as being a "component of interest" (hereinafter referred to as a "first pixel region acquisition process"). A component value distribution indicating a distribution of the magnitudes of components of interest (component values) is acquired (step S10). A "blurring process" to be discussed below is then performed on the component value distribution acquired in step S10 (step S12). If any pixel is handled as a "pixel of interest", the mean value of the component values of the components of interest of a plurality of pixels falling with a constant range of a rectangle or a circle centered on the pixel of interest is treated as the component value of the component of interest of the pixel of interest. For example, it is assumed in the blurring process that the mean value of the component values of 9 pixels including the pixel of interest and 8 pixels surrounding the pixel of interest serves as the component value of the pixel of interest for each color mixed component. In such a case, if the component value distribution of FIG. 9 is acquired in step S10, the blurring process results in a component value distribution of FIG. 10. If a pixel labeled reference numeral 63 is viewed, the component value of the pixel prior to the blurring process is 50. The component value of the pixel subsequent to the blurring process is determined as below.

$$P = (90 + 70 + 70 + 30 + 50 + 30 + 20 + 40 + 10)/9$$
$$= 46$$

The blurring process is performed because the mean value of the component values of the pixels within a relatively wider area contributes more to the generation of the color break caused in each color mixed component than the magnitudes of the component values of the pixels within a smaller area. The blurring process is performed in view of this fact, and in the examples of FIG. 9 and FIG. 10, the pixel having a highest component value is the pixel labeled reference numeral 62 prior to the blurring process but is the pixel labeled reference numeral 61 subsequent to the blurring process.

Figure 11:
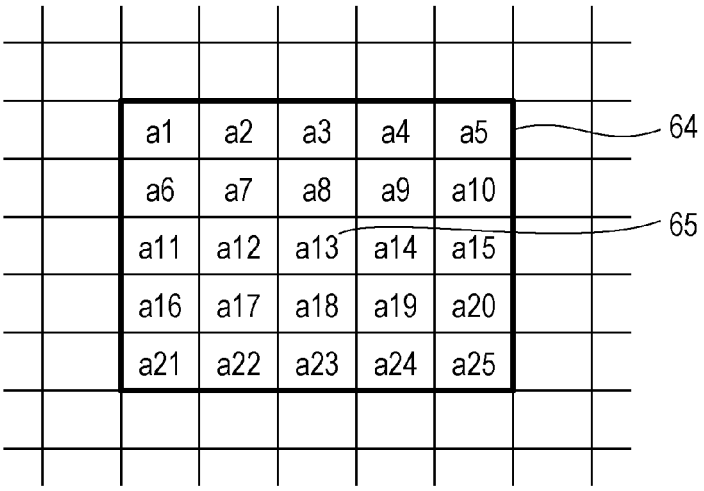
FIG. 11 illustrates the blurring process in the first embodiment of the present invention.

The technique of the blurring process is not limited to the technique described above. For example, a larger weight coefficient is attached to a pixel as the pixel is closer to the pixel of interest, and the mean value (weighted mean value) of the component values (subsequent to the weighting operation) of the components of interest of a plurality of pixels falling with a constant range of a rectangle or a circle centered on the pixel of interest is treated as the component value of the component of interest of the pixel of interest. This operation is described with reference to FIG. 11. An area surrounded by a solid outline labeled reference numeral 64 includes pixels having component values a1 through a25 as illustrated in FIG. 11. If a pixel labeled reference numeral 65 is handled as a pixel of interest, a component value Po of the pixel of interest subsequent to the blurring process may be determined as below.

$$A1 = a13$$

$$A2 = a7+a8+a9+a12+a14+a17+a18+a19$$

$$A3 = a1+a2+a3+a4+a5+a6+a10+a11+a15+a16+a20+a21+a22+a23+a24+a25$$

$$Po = (A1\times5+A2\times1.5+A3\times0.5)/25$$

In this technique, the weighting operation may be based on the Gaussian distribution.

Figure 12:
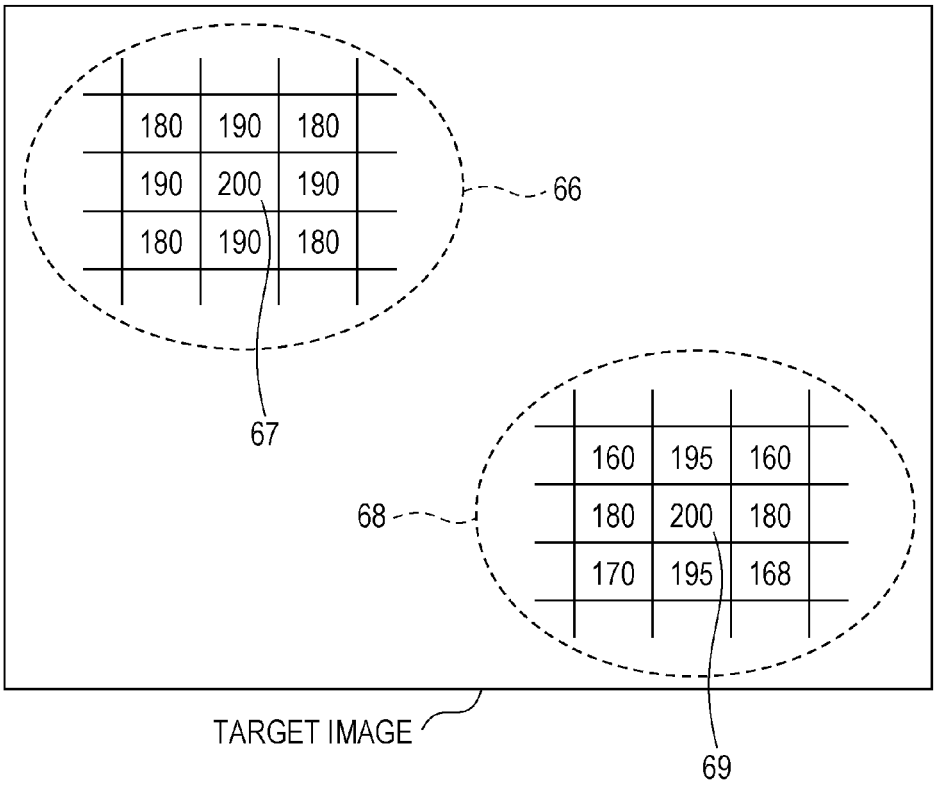
FIG. 12 illustrates identification of a first reference pixel in the first embodiment of the present invention.

Subsequent to the blurring process, a process is performed to identify a pixel (hereinafter referred to as a "first reference pixel") serving as a reference in the first pixel region Z1 (step S14). In the present embodiment, the first reference pixel is a pixel having the highest component value in the component value distribution subsequent to the blurring process. As illustrated in FIG. 10, the pixel labeled reference numeral 61 is the first reference pixel. If a plurality of pixels having the highest component value are present, the first reference pixel is determined in view of the component value of a pixel adjacent to each of the pixels having the highest component value. For example, as illustrated in FIG. 12, there are present pixels (labeled reference numerals 67 and 69) having the highest component value (200) respectively in an area 66 on the top left portion of the target image and an area 68 on the bottom right portion of the target image. In the area 66, the mean value of the component values of 8 pixels surrounding the pixel labeled reference numeral 67 is 185 while in the area 68, the mean value of the component values of 8 pixels surrounding the pixel labeled reference numeral 69 is 176. The pixel labeled reference numeral 67 in the area 66 on the top left portion of the screen thus serves as the first reference pixel.

After the first reference pixel is identified in step S14, the component value of the first reference pixel is compared with the pixel of each of the surrounding pixels (adjacent pixels) and a pixel having within a predetermined range a difference from the component value of the first reference pixel or a rate of the difference (to the component value of the first reference pixel) is extracted (step S16). A region of the pixels extracted in step S16 is referred to as the first pixel region Z1. In step S16, the number of pixels of the first pixel region Z1 is determined (an area of the first pixel region Z1 is calculated from the number of pixels), and the mean value of the component values of the first pixel region Z1 is determined. If the blurring process results in the component value distribution of FIG. 13, a pixel labeled reference numeral 71 serves as the first reference pixel. If a pixel having a difference from the component value of the first reference pixel equal to or below 20 is designed to be extracted in step S16, the pixels within an area surrounded a solid outline labeled reference numeral 72 are extracted as illustrated in FIG. 14. As a result, the area surrounded by the solid outline labeled reference numeral 72 in FIG. 14 becomes the first pixel region Z1.

1.2.2 Determination Method of Second Pixel Region

The determination method of the second pixel region is described. As previously described, the first pixel region Z1 is determined on a per color mixed component basis. In contrast, only one second pixel region Z2 is determined (for one target image).

Figure 15:
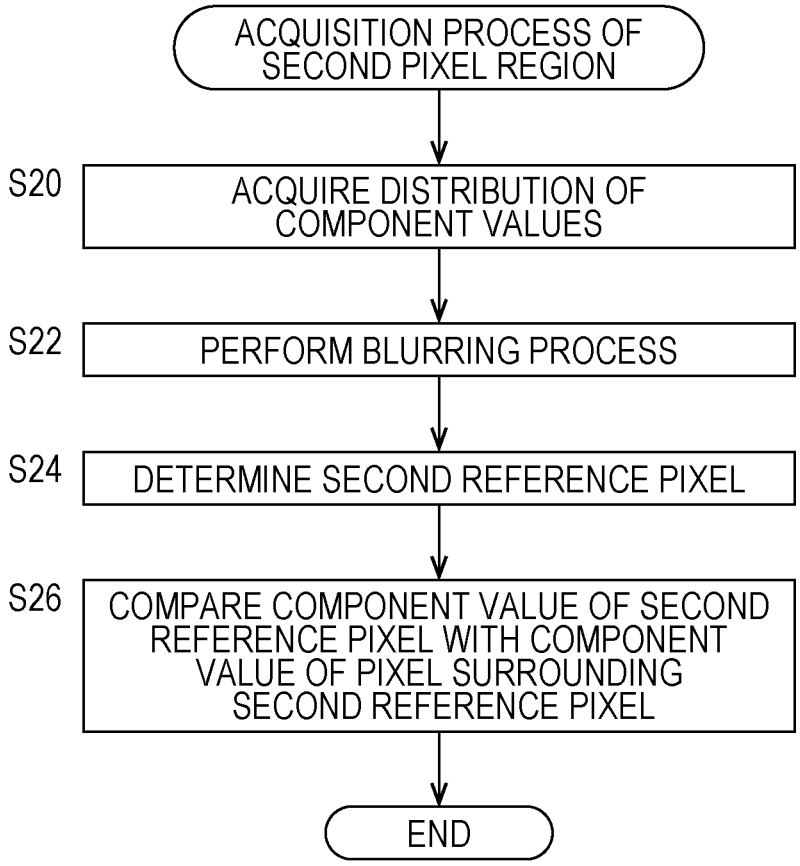
FIG. 15 is a flowchart illustrating a procedure of an acquisition process of a second pixel region in the first embodiment of the present invention.

FIG. 15 is a flowchart illustrating a procedure of a process to determine the second pixel region (hereinafter referred to as a "second pixel region acquisition process"). The component value distribution of the entire image is acquired from the magnitude (component value) of the maximum mono-color component at each pixel (step S20). The mean value of the magnitudes (component values) of the three mono-color components at each pixel may be determined, and the component value distribution of the entire target image may be determined from the mean value. In the same manner as in step S12 of the first pixel region acquisition process, the blurring process is performed on the component value distribution acquired in step S20 (step S22).

Subsequent to the blurring process, a process is performed to identify a pixel serving as a reference in the second pixel region Z2 (hereinafter referred to as a "second reference pixel") (step S24). In the present embodiment, the second reference pixel is a pixel having the lowest component value in the component value distribution subsequent to the blurring process. If a plurality of pixels having the lowest component value are present, the second reference pixel is determined in view of the component value of a pixel adjacent to each of the pixels having the lowest component value. In such a case, the second pixel region is determine in the same manner as in step S14 in the first pixel region acquisition process that is performed when a plurality of pixels having the highest component value are present.

Figure 16:
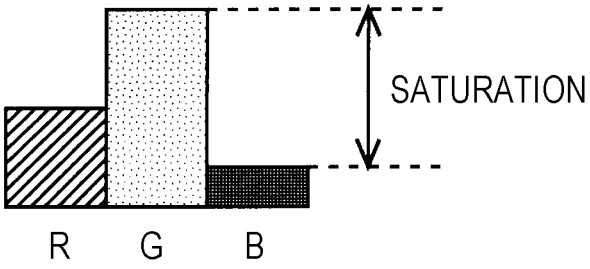
FIG. 16 illustrates saturation in the first embodiment of the present invention.

After the second reference pixel is identified in step S24, the component value of the second reference pixel is compared with the component value of each of the surrounding pixels (adjacent pixels) and a pixel having within a predetermined range a difference from the component value of the second reference pixel or a rate of the difference (to the component value of the second reference pixel) is extracted (step S26). A region of the pixels extracted in step S26 is referred to as the second pixel region Z2. In step S26, the number of pixels of the second pixel region Z2 is determined (an area of the second pixel region Z2 is calculated from the number of pixels), the mean value of the component values of the second pixel region Z2 is determined, and the mean value of saturations in the second pixel region Z2 is determined. The term saturation herein refers to a difference between the magnitude of the maximum mono-color mixed component and the minimum mono-color mixed component in each pixel (see FIG. 16).

1.2.3 Determination Method of Color Break Strength

The determination method of the color break strength of the present embodiment is described. The color break strength is determined on a per color mixed component basis. More specifically, in the present embodiment, the color break strength is determined for each of the white component, the yellow component, the magenta component, and the cyan component.

If one of the color mixed components is handled as a component of interest, the color break strength V of the component of interest is determined in accordance with the following expression (1):

$$V=K\times F1(C)\times G1(M)\times G2(S)\times F2(A)\times G3(D) \quad (1)$$

where C represents the mean value of the component values in the first pixel region Z1, M represents the component value of the maximum mono-color component in the second pixel region Z2, S represents the mean value of luminance in the second pixel region Z2, A represents the area of the second pixel region Z2, and D represents a distance between the first pixel region Z1 and the second pixel region Z2. K represents a predetermined coefficient of the component of interest, each of F1( ) and F2( ) represents a increasing function, and each of G1( ), G2( ), and G3( ) represents a decreasing function. It is noted that K may be a function having any value as a variable (argument).

K in expression (1) is determined by accounting for the noticeability with which the color break strength is visibly recognized on each color mixed component. Typically, cyan is easier to recognize than magenta on the color break strength, and also yellow is easier to recognize than cyan on the color break strength. Furthermore, a color mixture of three colors is easier to recognize than a color mixture of two colors on the color break strength. K is thus preferably determined so that a higher color break strength is set as a color mixed component has a color break strength easier to recognize.

1.2.4 State of LED of each color during extension subframe period

Figure 17:
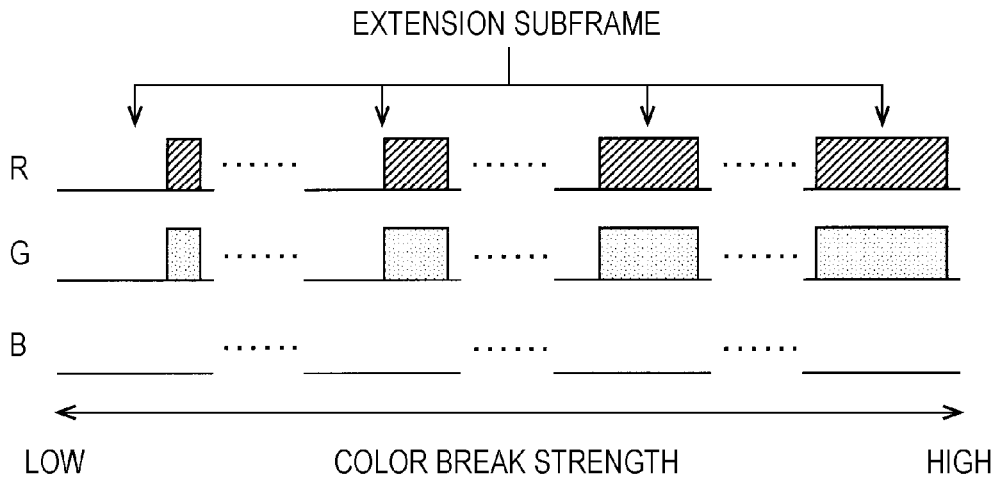
FIG. 17 illustrates a magnitude of a maximum color mixed component contained light output from a backlight unit in the first embodiment of the present invention during the extension subframe period.

Described below is how the state of the LED of each color is controlled during the extension subframe period. In the present embodiment, only an LED having a color that has the highest color break strength out of the color mixed components (hereinafter referred to as referred to as a "maximum color mixed component") is set to be in the light-on state. For example, if the maximum color mixed component is a yellow component, a red LED and a green LED are set to be in the light-on state during the extension subframe period. If the maximum color mixed component is a white component, all the LEDs of all the colors are set to be in the light-on state during the extension subframe period. As illustrated in FIG. 17, the magnitude of the maximum color mixed component contained in the light output from the backlight unit during the extension subframe period is increased more as the magnitude of the color break strength of the maximum color mixed component is larger, and is decreased more as the magnitude of the color break strength of the maximum color mixed component is smaller.

The amount of light emission of an LED of a color forming the maximum color mixed component during the extension subframe period may be set to be maximized in a simple way. Alternatively, the amount of light emission during the extension subframe period may be determined so that if the transmittance of the liquid crystal at a pixel having a largest magnitude (component value) of the maximum color mixed components over the entire target image is set to be maximized, a desired luminance is obtained at that pixel.

Figure 18:
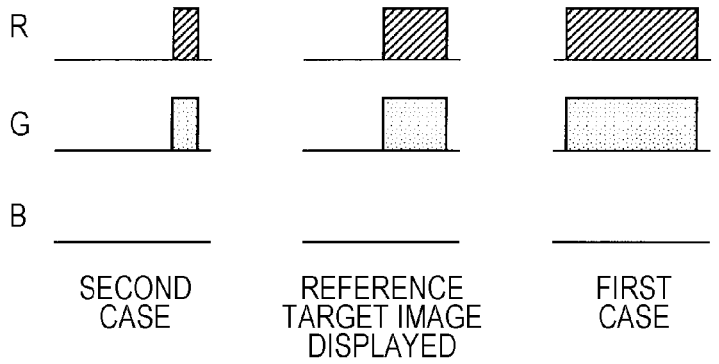
FIG. 18 illustrates the magnitude of the maximum color mixed component contained the light output from the backlight unit in the first embodiment of the present invention during the extension subframe period.

The color break strength is determined in accordance with expression (1). A given target image may now be set to be a reference target image. If an image containing maximum color mixed components large in magnitude contained in the first pixel region Z1 in comparison with the reference target image is displayed (see a first case in FIG. 18), the magnitude of the maximum color mixed component contained in the light output from the backlight unit during the extension subframe period (hereinafter referred to as a "maximum component extension emission amount" for convenience) becomes larger than when the reference target image is displayed (see the reference target image displayed in FIG. 18). On the other hand, if an image containing maximum color mixed components small in magnitude contained in the first pixel region Z1 in comparison with the reference target image is displayed (see a second case in FIG. 18), the maximum component extension emission amount becomes lower than when the reference target image is displayed. Also, if an image containing maximum color mixed components small in magnitude contained in the second pixel region Z2 in comparison with the reference target image is displayed, the maximum component extension emission amount becomes higher than when the reference target image is displayed. On the other hand, if an image containing maximum color mixed components large in magnitude contained in the second pixel region Z2 in comparison with the reference target image is displayed, the maximum component extension emission amount becomes lower than when the reference target image is displayed. Also, if an image with the second pixel region Z2 low in saturation in comparison with the reference target image is displayed, the maximum component extension emission amount becomes higher than when the reference target image is displayed. On the other hand, if an image with the second pixel region Z2 high in saturation in comparison with the reference target image is displayed, the maximum component extension emission amount becomes lower than when the reference target image is displayed. Also, if an image with the second pixel region Z2 large in area in comparison with the reference target image is displayed, the maximum component extension emission amount becomes higher than when the reference target image is displayed. On the other hand, if an image with the second pixel region Z2 small in area in comparison with the reference target image is displayed, the maximum component extension emission amount becomes lower than when the reference target image is displayed. Also, if an image with a shorter distance between the first pixel region Z1 and the second pixel region Z2 in comparison with the reference target image is displayed, the maximum component extension emission amount becomes higher than when the reference target image is displayed. On the other hand, if an image with a longer distance between the first pixel region Z1 and the second pixel region Z2 in comparison with the reference target image is displayed, the maximum component extension emission amount becomes lower than when the reference target image is displayed.

1.3 Advantages

According to the embodiments, in the liquid crystal display apparatus operating in the field sequential mode, one frame period is divided into the three subframes to display mono-color images and the extension subframe to display a color mixed image. The display color during the extension subframe period is determined in accordance with the color break strength that is an index of the noticeability of the generation of the color break and is determined on a per color mixed component basis. More in detail, the LED of a color forming a color mixed component (the maximum color mixed component) highest in color break strength is set to the light-on state. The higher the color break strength of the maximum color mixed component is, the more the maximum color mixed component is to be contained in the light output from the backlight unit during the extension subframe period. The color break strength herein is determined in view of a relationship with an area containing more a color mixed component causing the color break strength (first pixel region) and an area containing less the color mixed component (second pixel region) in the target image. For this reason, the generation of the color break is effectively reduced if an image having a color break appearing strongly in a localized fashion is displayed. As understood from expression (1) (see K in the expression), a weighting process accounting for the noticeability with which a person visibly recognizes the color break strength on a per color mixed component basis is performed in the calculation of the color break strength. According to the present embodiment, the generation of the color break is more effectively controlled. As described above, the present embodiment provides the liquid crystal display apparatus operating in the field sequential mode that effectively reduces the generation of the color break.

1.4 Modifications

In the above embodiment, expression (1) to determine the color break strength includes the five functions (the two increasing functions and the three decreasing functions). The present invention is not limited to this expression. The expression may include only one of the five functions. The expression may be a combination of any two or more functions selected from the five functions. For example, "V=K×F1(C)", "V=K×F2(A)", or "V=K×G3(D)". Also, acceptable expressions may be "V=K×F1(C)×F2(A)", "V=K×F1(C)×G3(D)", "V=K33 G1(M)×G2(S)×G3(D)", or "V=K×G1(M)×G2(S)×F2(A)×G3(D)". Although the effect of reducing the color break strength is smaller than the above embodiment, the color break strength may be determined in accordance with the expression (1) but without K, namely, in accordance with the following expression (2).

$$V=F1(C)\times G1(M)\times G2(S)\times F2(A)\times G3(D) \quad (2)$$

Expression 2 may also be modified. For example, modified expression (2) may only one of the five functions. Modified expression (2) may be a combination of any two or more functions selected from the five functions. For example, "V=F1(C)", "V=F2(A)", or "V=G3(D)". Also, acceptable expressions may be "V=F1(C)×F2(A)", "V=F1(C)×G3(D)", "V=G1(M)×G2(S)×G3(D)", or "V=G1(M)×G2(S)×F2(A)×G3(D)".

Figure 19:
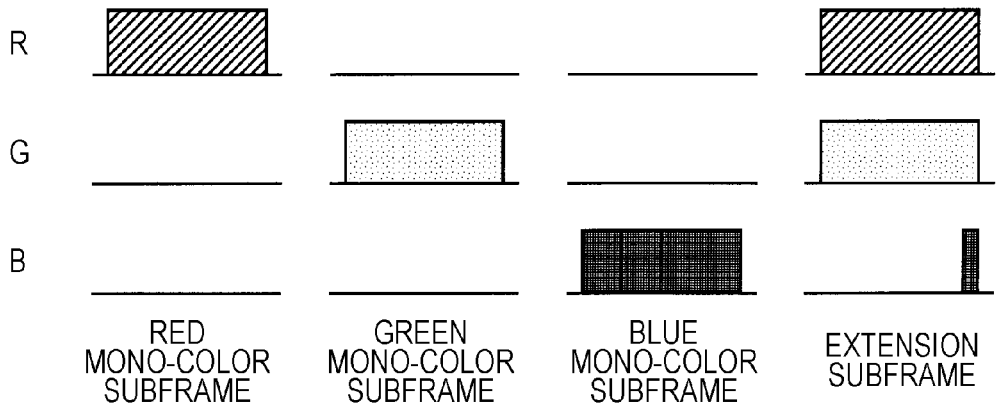
FIG. 19 diagrammatically illustrates a display color in a modification of the first embodiment during each subframe period.

In the above embodiment, an LED of a color other than colors forming the maximum color mixed component (green in the example of FIG. 4) is fully set to the light-off state during the extension subframe period. But the present invention is not limited to this arrangement. A color forming a color mixed component other than the maximum color mixed component may be displayed during a period as long as 10 percent of the extension subframe period. For example, as illustrated in FIG. 19, a white image may be displayed during part of the extension subframe period.

2. Second Embodiment 2.1 Configuration and Operation

A second embodiment remains unchanged from the first embodiment in terms of the configuration of the liquid crystal display apparatus and the structure of the one frame period, and the discussion thereof is omitted herein (see FIG. 1 and FIG. 2). The determination method of the first pixel region, the determination method of the second pixel region, and the determination method of the color break strength are identical to those in the first embodiment, and the discussion thereof is omitted herein.

Figure 20:
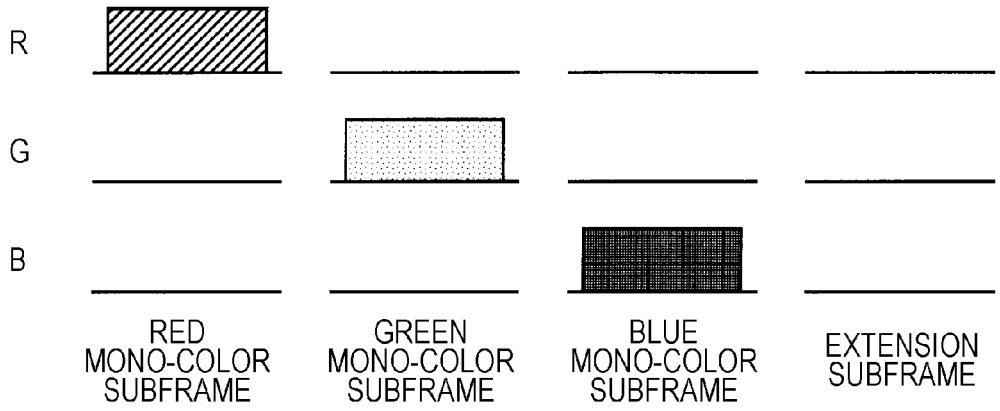
FIG. 20 diagrammatically illustrates a display color in a liquid crystal display apparatus of a second embodiment of the present invention during each subframe period.

If the color break strengths of all the color mixed components contained in the light output from the backlight unit are lower than a predetermined level (hereinafter referred to as a "comparative level") in the present embodiment, the light-source control signal generating unit 464 outputs a light-source control signal S so that the LEDs of all the colors shift to the light-off state during the extension subframe period as illustrated in FIG. 20.

2.2 Advantages

According to the present embodiment, all the LEDs shift to the light-off state during the extension subframe period if an image having a color break strength that is less visibly recognized is displayed. This leads to an advantage of low power consumption. Since this arrangement introduces a period of black image displaying in one frame period, a display screen similar to displaying responsive to impulse driving by CRT (Cathode Ray Tube) is presented. This arrangement controls a phenomenon called "motion blur" in motion image displaying (a phenomenon in which an outline of an moving object is visibly recognized in a blurred state by a person). As described above, power consumption is reduced while display quality is increased.

2.3 Modifications

Figure 21:
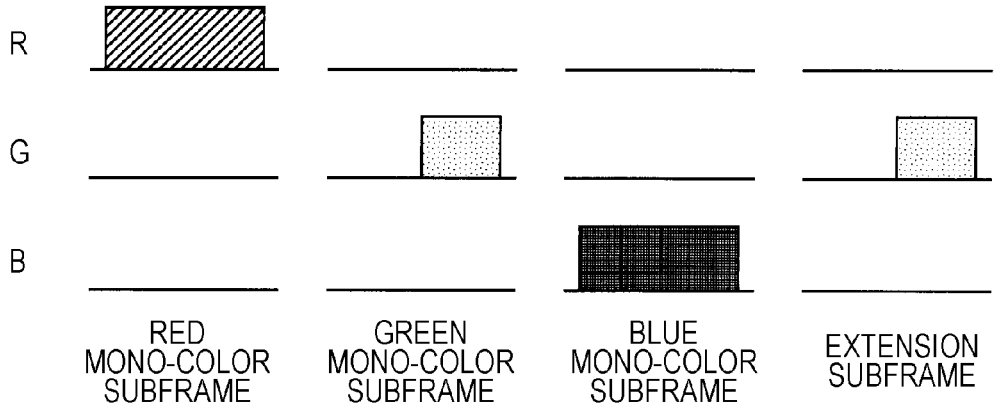
FIG. 21 diagrammatically illustrates a display color in a modification of the second embodiment of the present invention during each subframe period.

According to the second embodiment, all the LEDs shift to the light-off state during the extension subframe period if the color break strengths of all the color mixed components are lower than the comparative level, the LEDs of all the colors shift to the light-off state during the extension subframe period. The present invention is not limited to this arrangement. The LED of any one color may set to be in the light-on state during the extension subframe period. In such a case, during a mono-color subframe period of the color which is set to the light-on state during the extension subframe period, the corresponding LED is set to the light-on state at an amount of light emission lower than the standard level thereof in view of the amount of light emission during the extension subframe period. For example, if a green LED is set to the light-on state during the extension subframe period, the green LED is set to the light-on state at a light emission level half as high as the standard level during the green mono-color subframe period. During the extension subframe period, the green LED is set to the light-on state at the same emission level (see FIG. 21).

As in the second embodiment, the modification controls the needless lighting of the LED during the extension subframe period, and the power consumption is reduced. If a current control driving mechanism is employed that current controls a light source with current-luminance characteristics in which a conversion efficiency from current to luminance decreases with an increasing current, a light source of any one of colors may be driven twice but at a current less than half the standard current. The power consumption is even more effectively reduced. Furthermore, the generation of flickering is reduced more than in the second embodiment.

The modification may include an arrangement that switches between "all light-off state with the LEDs of all colors set to the light-off state (all light-off)" and "the LED of one color set to the light-on state (mono-color light-on)" during the extension subframe period if the color break strengths of all the color mixed components are lower than the comparative level. With this arrangement employed, the all light-off may be activated when a moving image is displayed, and the mono-color light-on may be activated when a still image is displayed. In view of the generation of flickering, the all light-off may be activated when a frame frequency is relatively high, and the mono-color light-on may be activated when the frame frequency is relatively low.

3. Third Embodiment

3.1 Summary

Figure 22:
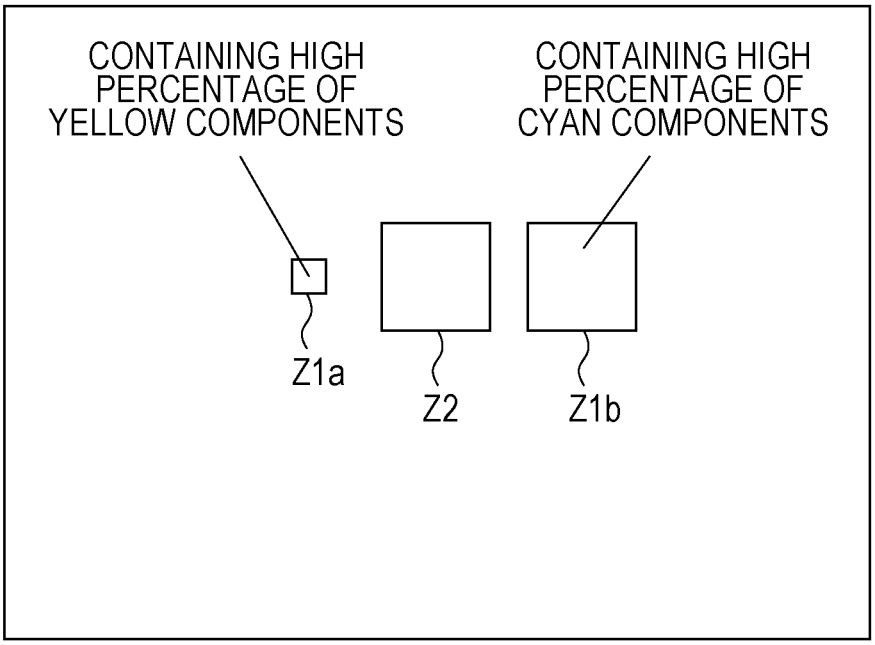
FIG. 22 illustrates a plurality of color mixed components likely to suffer from color break.
Figure 23:
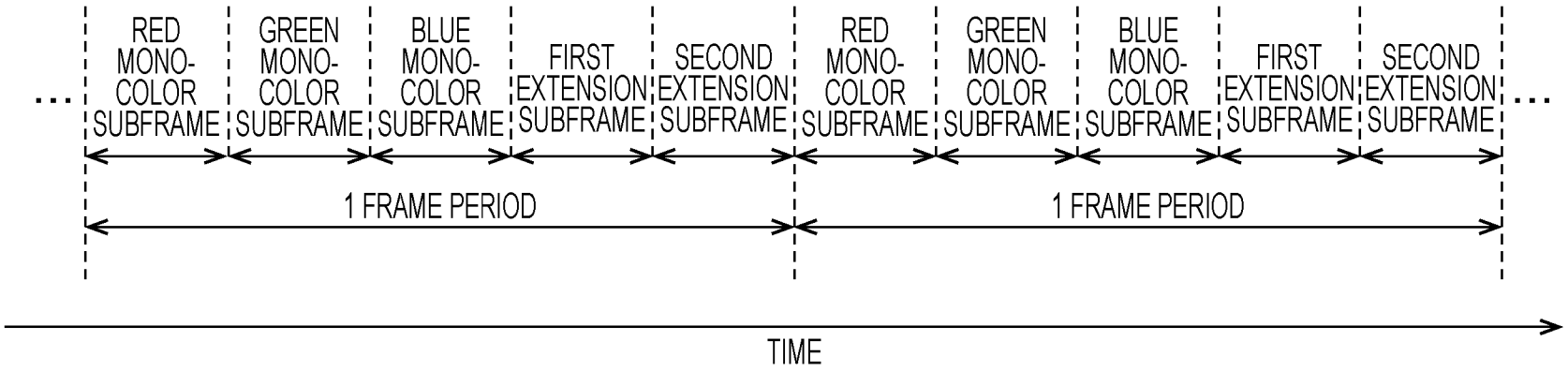
FIG. 23 illustrates a structure of a frame period in a liquid crystal display apparatus of a third embodiment of the present invention.

Each of the above embodiments, only one extension subframe period is arranged in one frame period. However, the color break strength may be visibly recognized in a plurality of color mixed components depending on the target image. For example, there are present within the target image a region Z1*a* containing a high percentage of yellow components and a region Z1*b* containing a high percentage of cyan components as illustrated in FIG. 22. In such a case, even if a yellow image is displayed during the extension subframe period (one extension subframe is arranged within one frame period), a color break strength caused by the cyan component occurs. According to the present embodiment, two extension subframe periods (a first extension subframe and a second extension subframe) are arranged within one frame period as illustrated in FIG. 23. The configuration of the liquid crystal display apparatus remains unchanged from that of the first embodiment, and the discussion thereof is omitted herein (see FIG. 1).

3.2 State of LED of Each Color During Extension Subframe Period

Figure 24:
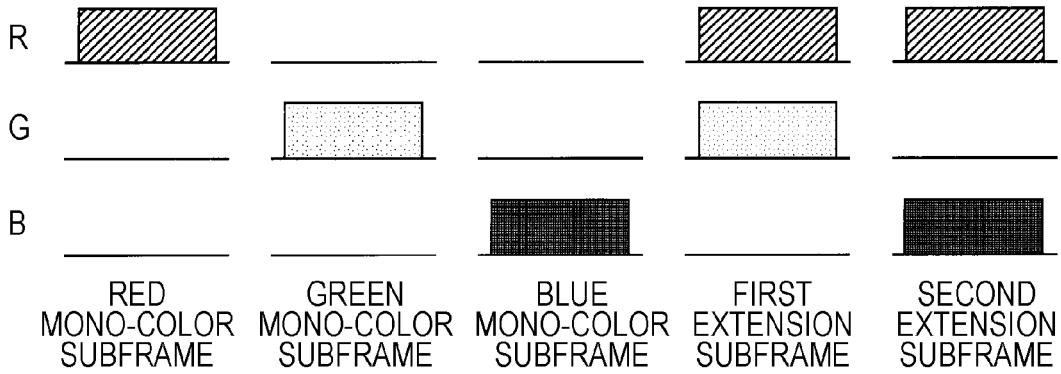
FIG. 24 diagrammatically illustrates a display color in a third embodiment during each subframe period.

Described below is how the state of the LED of each color is controlled during the extension subframe period. In the present embodiment, only the LED of a color forming a maximum color mixed component is set to the light-on state, and only the LED of a color having the second highest color break strength out of the color mixed components (hereinafter referred to as a "second color mixed component") is set to the light-on state. For example, if the maximum color mixed component is a yellow component, and second color mixed component is a magenta component, a red LED and a green LED are set to the light-on state during the first extension subframe period and the red LED and a blue LED are set to the light-on state during the second extension subframe period as illustrated in FIG. 24. The light emission amount of each color during the first extension subframe period and during the second extension subframe period may be determined in the same way as in the first embodiment.

3.3 Advantages

According the present embodiment, the generation of color break strength is effectively reduced even when an image suffering from the color break strength in a plurality of color mixed components is displayed.

3.4 Modifications

Figure 25:
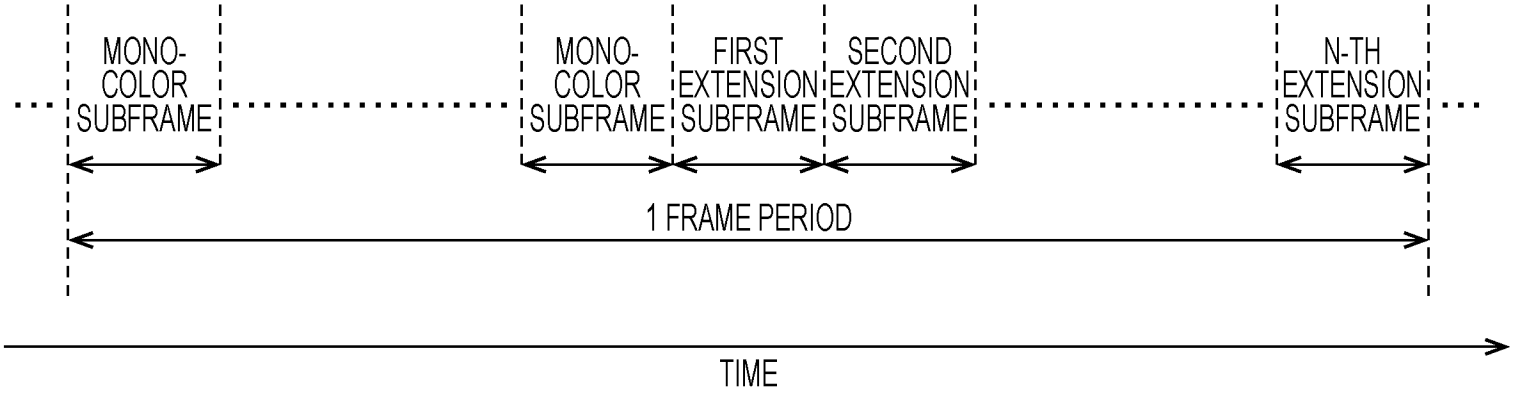
FIG. 25 illustrates a structure of a frame period in a modification of the third embodiment of the present invention.

According to the third embodiment, the two extension subframe periods are arranged in one frame period. However, the number of extension subframe periods is not limited to any particular value. If the backlight unit includes three LEDs of red (R), green (G), and blue (B), four color mixed components (a white component, a yellow component, a magenta component, and a cyan component) are contained in the light output from the backlight unit, and a maximum of four extension subframe periods may be arranged within one frame period. If N color mixed components are contained in the light output from the backlight unit, one frame period may include a plurality of mono-color subframes and N extension subframe periods as illustrated in FIG. 25.

4. Fourth Embodiment

4.1 Summary

A color mixed component from which the color break strength is strongly visibly recognized is different from target image to target image. For this reason, the color mixed component from which the color break strength is strongly visibly recognized may change in response to a change in the target image during moving image displaying or at a timing when display images are switched from one to another during still image displaying. In such a case, if a display color is sharply changed during the extension subframe period, flickering may be visibly recognized on the screen. According to the present embodiment, the light-source control signal generating unit 464 outputs the light-source control signal S so that the display color gradually changes during the extension subframe period when the color mixed component from which the color break strength is strongly visibly recognized changes in the target image. The configuration of the liquid crystal display apparatus and the structure of the one frame period remain unchanged from those of the first embodiment, and the discussion thereof is omitted herein (see FIG. 1 and FIG. 2).

4.2 Change in Display Color During Extension Subframe Period

Figure 26:
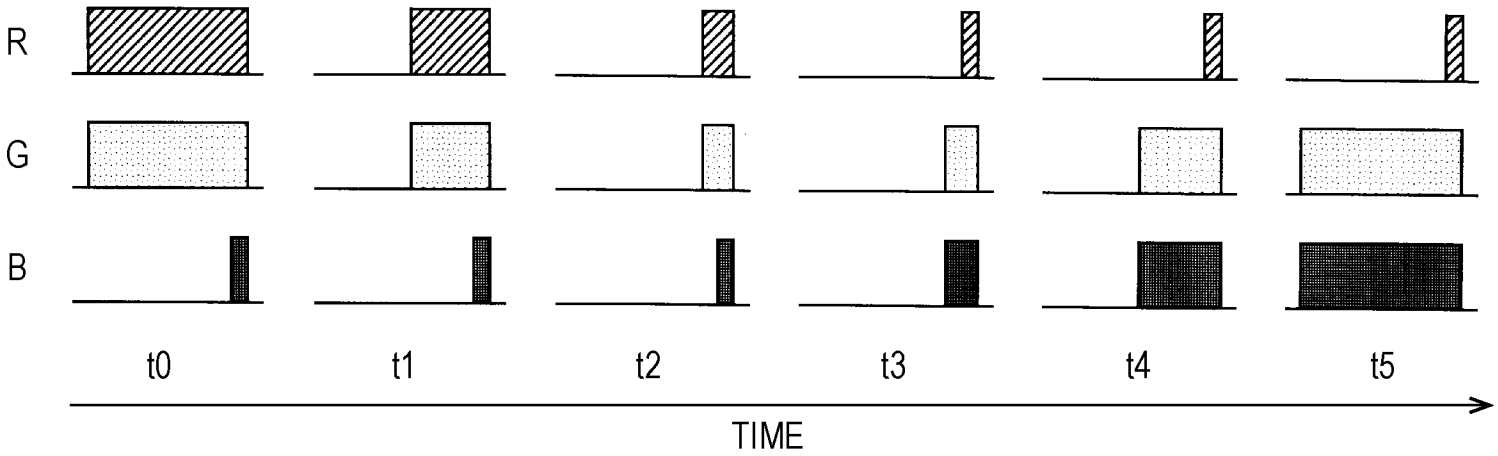
FIG. 26 diagrammatically illustrates a change in a display color in a liquid crystal display apparatus of a fourth embodiment of the present invention during an extension subframe period.
Figure 27:
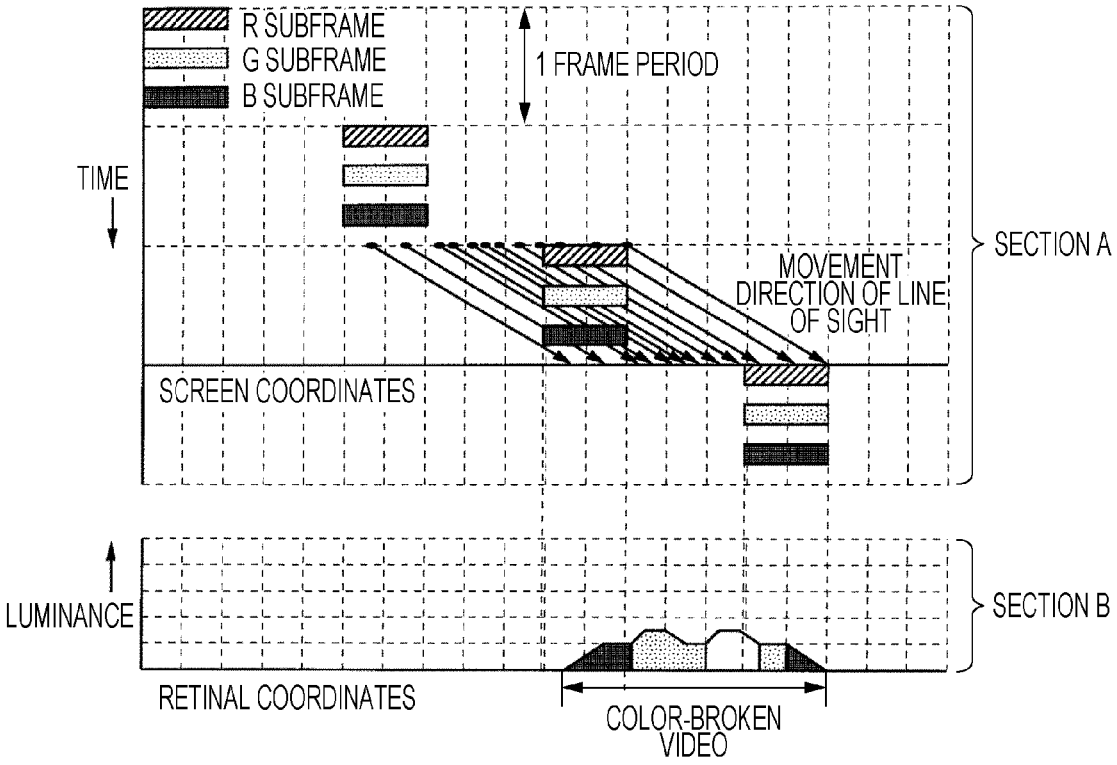
FIG. 27 illustrates the generation principle of the color break.

A change in the display color during the extension subframe period is described with reference to FIG. 26. It is now assumed herein that a color mixed component contained at a high percentage in the target image has changed from a yellow component to a cyan component. FIG. 26 illustrates only the extension subframe periods of six frame periods. An extension subframe period immediately prior to the start of the change is denoted by t0, and an extension subframe period at the end of the change is denoted by t5.

In the present embodiment, a display color changes across the extension subframe periods of five frame periods as illustrated in FIG. 26. More in detail, the magnitude of a yellow component in the extension subframe period is gradually reduced (during a period from t0 to t2). Then, the magnitude of a cyan component is gradually increased (during a period from t3 to t5). A blue LED lights during short periods of time from t0 to t2, and a red LED lights during short periods of time from t3 to t5. Alternatively, the blue LED and the red LED may be fully in the light-off state.

A change in the display color is further described in detail. A change may now occur in the color display during the extension subframe periods across M frame periods from t0 to tM (a change from yellow to cyan). Magnitudes (component values) of a red component, a green component, and a blue component at t0 are respectively represented by R0, G0, and B0, and magnitudes (component values) of the red component, the green component, and the blue component at tM are respectively represented by R1, G1, and B1. The magnitudes (component values) Ri, Gi, and Bi of the red component, the green component, and the blue component at ti (i is an integer within a range equal to or above 1 to equal to or below M) are respectively represented as below.

$$Ri=R0\times f(M-i,M)+R1\times f(i,M)$$

$$Gi=\text{Large}(Ri,Bi)$$

$$Bi=B0\times f(M-i,M)+B1\times f(i,M)$$

where f(x, y) represents an increasing function defined within a range of $0\leq x\leq y$, and expression f(x,y) f(1−x, y)=1 always holds true. Large (A, B) is a function that selects A or B, whichever is greater.

4.3 Advantages

According to the present embodiment, if the color mixed component from which the color break strength is strongly visibly recognized changes, a change in the display color during the extension subframe periods occurs gradually across the plurality of frame periods. For this reason, the generation of flickering on the screen with the target image changed is reduced. In this way, the generation of the color break is reduced while the flickering on the screen is reduced.

5. Other Embodiments

In each of the above-described embodiments, the backlight unit includes the three color LEDs. The present invention is not limited to these embodiments. For example, LEDs of four or more colors may be employed. For example, a light source other than the LED may also be employed.

In each of the above-described embodiments, the liquid crystal display apparatus is employed. The present invention is not limited to the liquid crystal display apparatus. The present invention is applicable to a display apparatus other than the liquid crystal display apparatus as long as the display apparatus employs a light-source unit including light sources of a plurality of colors, and uses a mechanism that switches the color of the light source in the light-on state on a per subframe period basis.

REFERENCE SIGNS LIST

42 Frame rate converting unit
44 Video signal generating unit
46 Image analyzer
100 Display unit
200 Backlight unit
300 Panel drive circuit
400 Subframe image generator
462 Color break strength calculating unit
464 Light-source control signal generating unit
DIN Input image signal
DAT Target image data
S Light-source control signal
Z1 First pixel region
Z2 Second pixel region

The invention claimed is:

1. An image display apparatus including a display unit that includes a plurality of pixel formation regions arranged in a matrix, and a light-source unit that, includes light sources of a plurality of colors to irradiate the display unit with light, and controls the light sources for a light-on state/light-off state on a per color basis, the image display apparatus displaying a color video image by dividing one frame period into a plurality of subframe periods, and by switching on a light source for the light-on state to select the color thereof on a per subframe period basis, the image display apparatus comprising:

a color break strength calculating unit that determines a color break strength, serving as an index indicating the noticeability of a color break, of a color mixed component that is a mixture of two or more color components, in accordance with a target image that is an image to be displayed on the display unit during each frame period, and a light-source control unit that controls states of the light sources of the plurality of colors during each subframe period in accordance with the color break strength of each color mixed component, wherein one frame period includes a mono-color light-on subframe period during which the light sources of the plurality of colors light on with one color at a time, and an extension subframe period during which the light sources of the plurality of colors take any state, wherein if, with any color mixed component set as a component of interest and with the target image displayed on the display unit, a first pixel region is present as an area including one or more pixel formation regions where an image containing the component of interest is to be displayed, the color break strength calculating unit increases the color break strength of the component of interest more as a magnitude of the component of interest is larger in the first pixel region, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the maximum mono-color component is smaller in magnitude in the second pixel region, and wherein the light-source control unit controls the states of the light sources of the plurality of colors during the extension subframe period so that as the color break strength of a maximum color mixed component being a color mixed component having the highest color break strength is higher, a magnitude of the maximum color mixed component contained in light output from the light-source unit is larger during the extension subframe period.

2. The image display apparatus according to claim 1, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size.

3. The image display apparatus according to claim 1, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a distance between the first pixel region and the second pixel region is shorter.

4. The image display apparatus according to claim 1, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a difference in magnitude between the maximum mono-color component in the second pixel region and a minimum mono-color component in the second pixel region is smaller.

5. The image display apparatus according to claim 1, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size, increases the color break strength of the component of interest more as a distance between the first pixel region and the second pixel region is shorter, and increases the color break strength of the component of interest more as a difference in magnitude between the maximum mono-color component in the second pixel region and a minimum mono-color component in the second pixel region is smaller.

6. The image display apparatus according to claim 5, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=F1(C)\times G1(M)\times G2(S)\times F2(A)\times G3(D)$$

where C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

7. The image display apparatus according to claim 5, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=K\times F1(C)\times G1(M)\times G2(S)\times F2(A)\times G3(D)$$

where K represents a coefficient or a function, predetermined for the component of interest, C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

8. The image display apparatus according to claim 1, wherein the color break strength calculating unit determines the color break strength of each color mixed component by performing a predetermined weighting process on the color mixed component.

9. The image display apparatus according to claim 1, wherein one frame period comprises N extension subframe periods (N is an integer equal to or above 2), wherein with first through N-th color mixed components rated in order in terms of color break strength and respectively referred to as first through N-th components of interest, the light-source control unit controls the states of the light sources of the plurality of colors during the N extension subframe periods so that each of the N components of interest becomes the maximum color mixed component contained in the light output from the light-source unit during any one of the N extension subframe periods.

10. The image display apparatus according to claim 1, wherein if the color break strengths of all the color mixed components contained in the light output from the light-source unit are smaller in magnitude than a predetermined color break strength, the light-source control unit controls the states of the light sources of the plurality of colors during the extension subframe period so that all the light sources of the plurality of colors are in the light-off state during the extension subframe period.

11. The image display apparatus according to claim 1, wherein if the color break strengths of all the color mixed components contained in the light output from the light-source unit are smaller in magnitude than a predetermined color break strength, the light-source control unit controls the states of the light sources of the plurality of colors during each extension subframe period so that a light source of any one color from among the light sources of the plurality of colors shifts to the light-on state during the extension subframe period and so that the light source of the color in the light-on state during the extension subframe period also shifts to the light-on state during the mono-color light-on subframe period but at a light emission level lower than a standard light emission level in view of a light emission level during the extension subframe period.

12. The image display apparatus according to claim 1, wherein if a color mixed component having the highest color break strength from among all the color mixed components contained in the light output from the light-source unit changes from a first color mixed component to a second color mixed component in response to a change in the target image, the light-source control unit controls the states of the light sources of the plurality of colors during the extension subframe period so that, of the color mixed components contained in the light output from the light-source unit, the second color mixed component gradually increases in magnitude after the first color mixed component gradually decreases in magnitude during the extension subframe periods across a plurality of consecutive frame periods.

13. An image display apparatus including a display unit that includes a plurality of pixel formation regions arranged in a matrix, and a light-source unit that, includes light sources of a plurality of colors to irradiate the display unit with light, and controls the light sources for a light-on state/light-off state on a per color basis, the image display apparatus displaying a color video image by dividing one frame period into a plurality of subframe periods, and by switching on a light source for the light-on state to select the color thereof on a per subframe period basis, the image display apparatus comprising:

a color break strength calculating unit that determines a color break strength, serving as an index indicating the noticeability of a color break, of a color mixed component that is a mixture of two or more color components, in accordance with a target image that is an image to be displayed on the display unit during each frame period, and a light-source control unit that controls states of the light sources of the plurality of colors during each subframe period in accordance with the color break strength of each color mixed component, wherein one frame period includes a mono-color light-on subframe period during which the light sources of the plurality of colors light on with one color at a time, and an extension subframe period during which the light sources of the plurality of colors take any state, wherein if, with any color mixed component set as a component of interest and with the target image displayed on the display unit, a first pixel region is present as an area including one or more pixel formation regions where an image containing the component of interest is to be displayed, the color break strength calculating unit increases the color break strength of the component of interest more as a magnitude of the component of interest is larger in the first pixel region, wherein the light-source control unit controls the states of the light sources of the plurality of colors during the extension subframe period so that as the color break strength of a maximum color mixed component being a color mixed component having the highest color break strength is higher, a magnitude of the maximum color mixed component contained in light output from the light-source unit is larger during the extension subframe period, and wherein if the color break strengths of all the color mixed components contained in the light output from the light-source unit are smaller in magnitude than a predetermined color break strength, the light-source control unit controls the states of the light sources of the plurality of colors during the extension subframe period so that all the light sources of the plurality of colors are in the light-off state during the extension subframe period.

14. The image display apparatus according to claim 13, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size.

15. The image display apparatus according to claim 13, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a distance between the first pixel region and the second pixel region is shorter.

16. The image display apparatus according to claim 13, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the maximum mono-color component is smaller in magnitude in the second pixel region.

17. The image display apparatus according to claim 13, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a difference in magnitude between the maximum mono-color component in the second pixel region and a minimum mono-color component in the second pixel region is smaller.

18. The image display apparatus according to claim 13, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size, increases the color break strength of the component of interest more as a distance between the first pixel region and the second pixel region is shorter, increases the color break strength of the component of interest more as the maximum mono-color component is smaller in magnitude in the second pixel region, and increases the color break strength of the component of interest more as a difference in magnitude between the maximum mono-color component in the second pixel region and a minimum mono-color component in the second pixel region is smaller.

19. The image display apparatus according to claim 18, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=F1(C)\times G1(M)\times G2(S)\times F2(A)\times G3(D)$$

where C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

20. The image display apparatus according to claim 18, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=K\times F1(C)\times G1(M)\times G2(S)\times F2(A)\times G3(D)$$

where K represents a coefficient or a function, predetermined for the component of interest, C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

21. The image display apparatus according to claim 13, wherein the color break strength calculating unit determines the color break strength of each color mixed component by performing a predetermined weighting process on the color mixed component.

22. The image display apparatus according to claim 13, wherein one frame period comprises N extension subframe periods (N is an integer equal to or above 2), wherein with first through N-th color mixed components rated in order in terms of color break strength and respectively referred to as first through N-th components of interest, the light-source control unit controls the states of the light sources of the plurality of colors during the N extension subframe periods so that each of the N components of interest becomes the maximum color mixed component contained in the light output from the light-source unit during any one of the N extension subframe periods.

23. The image display apparatus according to claim 13, wherein if a color mixed component having the highest color break strength from among all the color mixed components contained in the light output from the light-source unit changes from a first color mixed component to a second color mixed component in response to a change in the target image, the light-source control unit controls the states of the light sources of the plurality of colors during the extension subframe period so that, of the color mixed components contained in the light output from the light-source unit, the second color mixed component gradually increases in magnitude after the first color mixed component gradually decreases in magnitude during the extension subframe periods across a plurality of consecutive frame periods.

24. An image display apparatus including a display unit that includes a plurality of pixel formation regions arranged in a matrix, and a light-source unit that, includes light sources of a plurality of colors to irradiate the display unit with light, and controls the light sources for a light-on state/light-off state on a per color basis, the image display apparatus displaying a color video image by dividing one frame period into a plurality of subframe periods, and by switching on a light source for the light-on state to select the color thereof on a per subframe period basis, the image display apparatus comprising:

a color break strength calculating unit that determines a color break strength, serving as an index indicating the noticeability of a color break, of a color mixed component that is a mixture of two or more color components, in accordance with a target image that is an image to be displayed on the display unit during each frame period, and a light-source control unit that controls states of the light sources of the plurality of colors during each subframe period in accordance with the color break strength of each color mixed component, wherein one frame period includes a mono-color light-on subframe period during which the light sources of the plurality of colors light on with one color at a time, and an extension subframe period during which the light sources of the plurality of colors take any state, wherein if, with any color mixed component set as a component of interest and with the target image displayed on the display unit, a first pixel region is present as an area including one or more pixel formation regions where an image containing the component of interest is to be displayed, the color break strength calculating unit increases the color break strength of the component of interest more as a magnitude of the component of interest is larger in the first pixel region, wherein the light-source control unit controls the states of the light sources of the plurality of colors during the extension subframe period so that as the color break strength of a maximum color mixed component being a color mixed component having the highest color break strength is higher, a magnitude of the maximum color mixed component contained in light output from the light-source unit is larger during the extension subframe period, and wherein if the color break strengths of all the color mixed components contained in the light output from the light-source unit are smaller in magnitude than a predetermined color break strength, the light-source control unit controls the states of the light sources of the plurality of colors during each extension subframe period so that a light source of any one color from among the light sources of the plurality of colors shifts to the light-on state during the extension subframe period and so that the light source of the color in the light-on state during the extension subframe period also shifts to the light-on state during the mono-color light-on subframe period but at a light emission level lower than a standard light emission level in view of a light emission level during the extension subframe period.

25. The image display apparatus according to claim 24, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size.

26. The image display apparatus according to claim 24, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a distance between the first pixel region and the second pixel region is shorter.

27. The image display apparatus according to claim 24, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the maximum mono-color component is smaller in magnitude in the second pixel region.

28. The image display apparatus according to claim 24, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as a difference in magnitude between the maximum mono-color component in the second pixel region and a minimum mono-color component in the second pixel region is smaller.

29. The image display apparatus according to claim 24, wherein if, with the target image displayed on the display unit, a second pixel region is present as an area including one or more pixel formation regions where a maximum mono-color component is to be displayed smaller in magnitude than the component of interest in the first pixel region, the color break strength calculating unit increases the color break strength of the component of interest more as the second pixel region is larger in area size, increases the color break strength of the component of interest more as a distance between the first pixel region and the second pixel region is shorter, increases the color break strength of the component of interest more as the maximum mono-color component is smaller in magnitude in the second pixel region, and increases the color break strength of the component of interest more as a difference in magnitude between the maximum mono-color component in the second pixel region and a minimum mono-color component in the second pixel region is smaller.

30. The image display apparatus according to claim 29, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=F1(C)\times G1(M)\times G2(S)\times F2(A)\times G3(D)$$

where C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

31. The image display apparatus according to claim 29, wherein if, with the target image displayed on the display unit, the second pixel region is present as an area including one or more pixel formation regions where the maximum mono-color component is to be displayed smaller in magnitude than the component of interest in the first pixel region, the color break strength calculating unit calculates the color break strength of the component of interest in accordance with the following expression:

$$V=K\times F1(C)\times G1(M)\times G2(S)\times F2(A)\times G3(D)$$

where K represents a coefficient or a function, predetermined for the component of interest, C represents a magnitude of the component of interest in the first pixel region, M represents a magnitude of the maximum mono-color component in the second pixel region, S represents a difference between a magnitude of the maximum mono-color component in the second pixel region and a magnitude of the minimum mono-color component in the second pixel region, A represents an area of the second pixel region, D represents a distance between the first pixel region and the second pixel region, each of F1( ) and F2( ) represents an increasing function, and each of G1( ), G2( ), and G3( ) represents a decreasing function.

32. The image display apparatus according to claim 24, wherein the color break strength calculating unit determines the color break strength of each color mixed component by performing a predetermined weighting process on the color mixed component.

33. The image display apparatus according to claim 24, wherein one frame period comprises N extension subframe periods (N is an integer equal to or above 2), wherein with first through N-th color mixed components rated in order in terms of color break strength and respectively referred to as first through N-th components of interest, the light-source control unit controls the states of the light sources of the plurality of colors during the N extension subframe periods so that each of the N components of interest becomes the maximum color mixed component contained in the light output from the light-source unit during any one of the N extension subframe periods.

34. The image display apparatus according to claim 24, wherein if a color mixed component having the highest color break strength from among all the color mixed components contained in the light output from the light-source unit changes from a first color mixed component to a second color mixed component in response to a change in the target image, the light-source control unit controls the states of the light sources of the plurality of colors during the extension subframe period so that, of the color mixed components contained in the light output from the light-source unit, the second color mixed component gradually increases in magnitude after the first color mixed component gradually decreases in magnitude during the extension subframe periods across a plurality of consecutive frame periods.

* * * * *